US009568855B2

(12) United States Patent
Hayashi et al.

(10) Patent No.: US 9,568,855 B2
(45) Date of Patent: Feb. 14, 2017

(54) DEVELOPING DEVICE, PROCESS CARTRIDGE, AND IMAGE FORMING APPARATUS FOR FORMING AN IMAGE ON A RECORDING MEDIUM USING AN ELECTROPHOTOGRAPHIC METHOD

(71) Applicant: CANON KABUSHIKI KAISHA, Tokyo (JP)

(72) Inventors: Kodai Hayashi, Suntou-gun (JP); Yoshihiro Mitsui, Numazu (JP); Nobuyoshi Yoshida, Suntou-gun (JP); Hisashi Taniguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 13/868,552

(22) Filed: Apr. 23, 2013

(65) Prior Publication Data

US 2013/0287450 A1 Oct. 31, 2013

(30) Foreign Application Priority Data

Apr. 26, 2012 (JP) ..... 2012-100955
Apr. 26, 2012 (JP) ..... 2012-100957

(51) Int. Cl.
*G03G 15/08* (2006.01)

(52) U.S. Cl.
CPC .. *G03G 15/0808* (2013.01); *G03G 2215/0813* (2013.01); *G03G 2215/0844* (2013.01)

(58) Field of Classification Search
CPC ..... G03G 15/0808; G03G 2215/0634; G03G 15/0889; G03G 2215/0813; G03G 2215/0844; G03G 2215/086
USPC ..... 399/281
See application file for complete search history.

(56) References Cited

U.S. PATENT DOCUMENTS 4,378,158 A * 3/1983 Kanbe ..... 399/281
5,170,213 A * 12/1992 Yamaguchi et al. ..... 399/281
5,701,563 A * 12/1997 Fukuda ..... G03G 15/0808 399/281
7,221,892 B2 * 5/2007 Sato ..... 399/283
8,150,301 B2 * 4/2012 Adachi ..... G03G 15/0896 399/281

(Continued)

FOREIGN PATENT DOCUMENTS

CN 1267004 A 9/2000
CN 1393742 A 1/2003

(Continued)

OTHER PUBLICATIONS translation of JP# 2004-004246A (Hosokawa).*

*Primary Examiner* — Robert Beatty
(74) *Attorney, Agent, or Firm* — Canon U.S.A. Inc., IP Division

(57) ABSTRACT

A developing device including a containing unit configured to be arranged below a supply member and contain a developer and a developer bearing member configured to bear the developer and develop an electrostatic latent image, further includes a supply member which is configured to supply the developer to the developer bearing member, to be arranged to form a nip portion between the supply member and the developer bearing member, and to rotate in a direction in which its surface moves from an upper end to a lower end of the nip portion, and a conveyance member which is configured to convey the developer contained in the containing unit onto the supply member.

9 Claims, 15 Drawing Sheets

(56) References Cited

U.S. PATENT DOCUMENTS

| | | | | |
|---|---|---|---|---|
| 9,280,133 | B2 * | 3/2016 | Yoshida | G03G 15/0806 |
| 2008/0298852 | A1 * | 12/2008 | Yamada | 399/279 |
| 2009/0245891 | A1 * | 10/2009 | Sakurai et al. | 399/286 |
| 2011/0002720 | A1 * | 1/2011 | Ooyoshi | 399/359 |
| 2013/0022376 | A1 * | 1/2013 | Fujino | G03G 15/0808<br>399/281 |
| 2013/0108329 | A1 * | 5/2013 | Yoshida | 399/281 |
| 2013/0308988 | A1 * | 11/2013 | Hirukawa | G03G 15/0877<br>399/281 |

FOREIGN PATENT DOCUMENTS

| | | | | |
|---|---|---|---|---|
| CN | 101334613 | A | | 12/2008 |
| JP | 07044099 | A | * | 2/1995 |
| JP | H09-319212 | A | | 12/1997 |
| JP | H11-311899 | A | | 11/1999 |
| JP | 2001-060037 | A | | 3/2001 |
| JP | 2001-350342 | A | | 12/2001 |
| JP | 2002278258 | A | * | 9/2002 |
| JP | 2003-173083 | A | | 6/2003 |
| JP | 2003-173083 | A | * | 6/2003 |
| JP | 2004004246 | A | * | 1/2004 |
| JP | 2005128525 | A | * | 5/2005 |
| JP | 2008-164916 | A | | 7/2008 |
| JP | 2009-015250 | A | | 1/2009 |
| JP | 2009-258267 | A | | 11/2009 |
| JP | 2010020041 | A | * | 1/2010 |
| JP | 2010-211052 | A | | 9/2010 |
| JP | 4977974 | B2 | | 7/2012 |

* cited by examiner

DEVELOPING DEVICE, PROCESS CARTRIDGE, AND IMAGE FORMING APPARATUS FOR FORMING AN IMAGE ON A RECORDING MEDIUM USING AN ELECTROPHOTOGRAPHIC METHOD

BACKGROUND OF THE INVENTION

Field of the Invention

The present invention relates to an image forming apparatus configured to form an image on a recording material using an electrophotographic method, and more particularly, to a developing device and a process cartridge that are applied to the image forming apparatus.

Description of the Related Art

In an image forming apparatus such as a printer using an electrophotographic image forming method (an electrophotographic process), an electrophotographic photosensitive member (hereinafter referred to as a "photosensitive member") serving as an image bearing member is uniformly charged, and the charged photosensitive member is selectively exposed to form an electrostatic image on the photosensitive member. The electrostatic image formed on the photosensitive member is visualized as a toner image using toner in a developer. The toner image formed on the photosensitive member is transferred onto a recording material such as a recording sheet or a plastic sheet, and the toner image transferred onto the recording material is fixed on the recording material by further applying heat and pressure thereto, thus image recording is performed.

Such an image forming apparatus generally requires supply of a developer and maintenance of various types of process units. To make the supply of the developer and the maintenance of the various types of process units easy, a photosensitive member, a charging unit, a developing unit, a cleaning unit, and others are collected in a frame as a cartridge. Thus formed process cartridge which is detachably attached to a main body of the image forming apparatus has been put into practical use. A process cartridge type enables an image forming apparatus superior in usability to be provided.

In recent years, a color image forming apparatus configured to form a color image using developers in a plurality of colors has widely used. As the color image forming apparatus, an inline type image forming apparatus has been known in which photosensitive members respectively corresponding to image forming operations using developers in a plurality of colors are arranged in line in a surface movement direction of an object to be transferred onto which a toner image is be transferred. The inline type color image forming apparatus includes one in which a plurality of photosensitive members is arranged in line in a direction (e.g., a horizontal direction) intersecting with a vertical direction (gravity direction). An inline type is an image forming type desirable in terms of easily coping with requests to increase an image forming speed and expand into a multifunction printer.

An inline type image forming apparatus in which a plurality of photosensitive members is arranged in line in a direction intersecting with a vertical direction includes one in which a plurality of photosensitive members is arranged below an intermediate transfer member serving as a member to be transferred or a recording material bearing member for conveying a recording material serving as a member to be transferred (see Japanese Patent Application Laid-Open No. 2003-173083).

In a case where the photosensitive member is arranged below the intermediate transfer member or the recording material bearing member, a fixing device and a developing device (or an exposure device) can be arranged at a distant, for example, in such a manner that the intermediate transfer member or the recording material bearing member is sandwiched therebetween within an image forming apparatus main body. Therefore, the developing device (or the exposure device) is not easily affected by heat from the fixing device.

On the other hand, if the photosensitive member is arranged below the intermediate transfer member or the recording material bearing member, as described above, a developer may be required to be supplied to a developing roller (developer bearing member) and a supply roller (supply member) against gravity. More specifically, a developing device configured to convey a developer from a developer containing unit arranged below the supply roller to the supply roller needs to be used. For the developing device thus configured, Japanese Patent Application Laid-Open No. 2003-173083 discusses a configuration for supplying sufficient toner against gravity from a developer containing unit to a supply roller. As illustrated in FIG. 7, in Japanese Patent Application Laid-Open No. 2003-173083, a supply roller (supply member) 50 rotates upward from below in a toner nip portion between a developing roller (developer bearing member) 40 and the supply member 50. Japanese Patent Application Laid-Open No. 2003-173083 discusses a method for bringing a receiving sheet 400 into contact with the lower side of the supply member 50 as a unit for supplying a developer to the supply member 50. According to this method, the receiving sheet 400 prevents the developer, which has adhered to the supply member 50, from dropping by gravity, to prevent a solid image from decreasing in density in such a manner that the developer, which can be supplied to the developer bearing member, does not decrease.

According to a configuration discussed in Japanese Patent Application Laid-Open No. 2003-173083, an additional member such as a receiving sheet needs to be provided on the lower side of the supply member 50 to sufficiently supply the developer from the developer containing unit arranged below the supply member 50 to the supply member 50, so that the configuration of the image forming apparatus becomes complicated.

Therefore, the present invention is directed to preventing a solid image from decreasing in density in a simple configuration in a developing device configured to convey a developer from a developer containing unit arranged below a supply member to the supply member.

SUMMARY OF THE INVENTION

According to an aspect of the present invention, a developing device used in an electrophotographic image forming apparatus includes a developer bearing member configured to bear a developer and develop an electrostatic latent image, a supply member configured to supply the developer to the developer bearing member, to be arranged to form a nip portion between the supply member and the developer bearing member, and to rotate in a direction in which its surface moves from an upper end to a lower end of the nip portion, a containing unit configured to be arranged below the supply member and contain the developer, and a conveyance member configured to convey the developer contained in the containing unit onto the supply member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

It is to be understood that the scope of the present invention is not limited to only sizes, materials, shapes, and a relative arrangement of components described in exemplary embodiments below unless otherwise specifically described.

An image forming apparatus and a process cartridge according to the present invention will be described below with reference to the drawings.

[Overall Configuration and Operation of Image Forming Apparatus]

Figure 1:
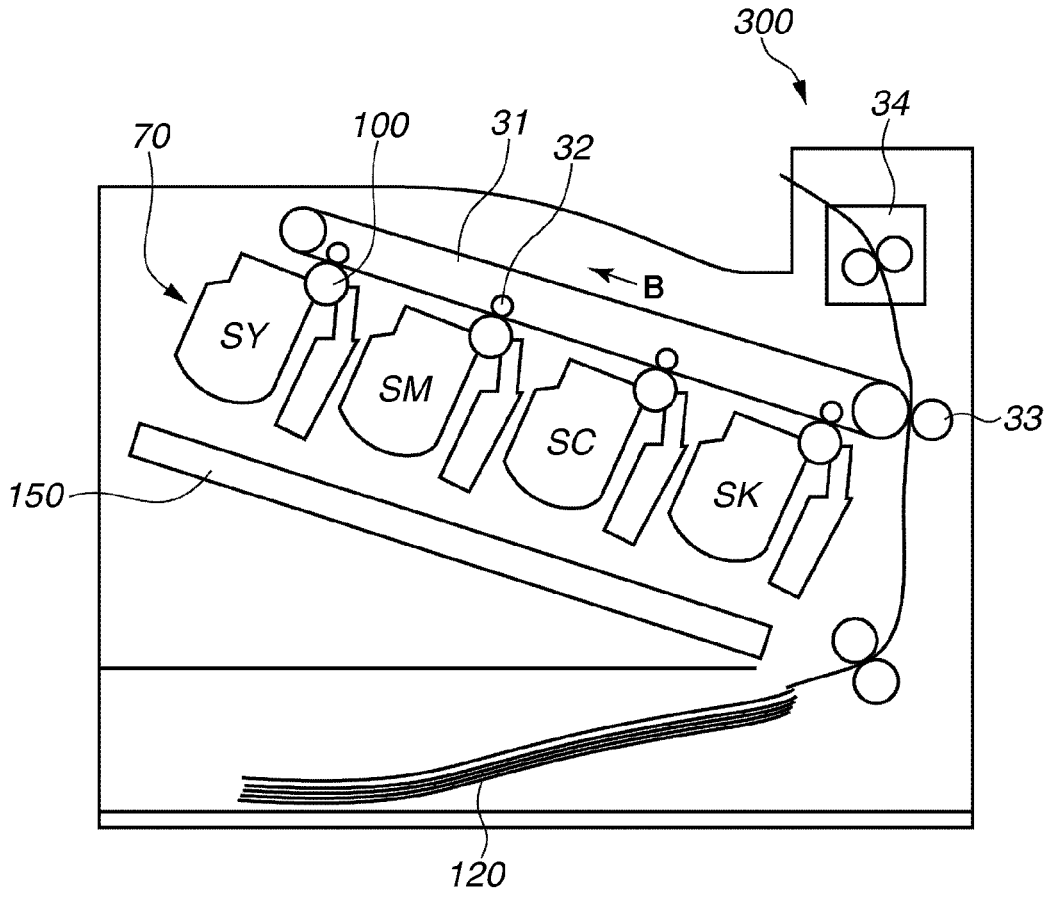
FIG. 1 is a schematic sectional view illustrating a configuration of an image forming apparatus according to a first exemplary embodiment.

An overall configuration of an electrophotographic image forming apparatus (image forming apparatus) according to a first exemplary embodiment will be described. FIG. 1 is a cross-sectional view of an image forming apparatus 300 according to the present exemplary embodiment. The image forming apparatus 300 according to the present exemplary embodiment is a full color laser beam printer employing an inline method or an intermediate transfer method. The image forming apparatus 300 can form a full color image on a recording material (e.g., a recording sheet, a plastic sheet, a cloth, etc.) according to image information. The image information is input to an image forming apparatus main body from an image reading device connected to the image forming apparatus main body or a host device such as a personal computer communicably connected to the image forming apparatus main body. The image forming apparatus 300 includes process cartridges 70 serving as a plurality of image forming units SY, SM, SC, and SK for respectively forming images in yellow (Y), magenta (M), cyan (C), and black (K). According to the present exemplary embodiment, the image forming units SY, SM, SC, and SK are arranged in line in a direction intersecting with a vertical direction.

The process cartridge 70 is detachably attached to the image forming apparatus 300 via a mounting unit such as a mounting guide or a positioning member provided in the image forming apparatus main body. According to the present exemplary embodiment, all the process cartridges 70 for the respective colors have the same shape. Toners in yellow (Y), magenta (M), cyan (C), and black (K) are respectively contained in the respective process cartridges 70. While the process cartridge 70 will be described according to the present exemplary embodiment, a developing unit 30 (a developing device) alone may be detachably attached to the image forming apparatus main body.

A photosensitive drum 100 serving as an image bearing member for bearing an electrostatic latent image is driven to rotate by a photosensitive drum driving motor (not illustrated) provided in the image forming apparatus main body. A scanner unit (an exposure device) 150 is arranged around the photosensitive drum 100. The scanner unit 150 is an exposure unit for irradiating the photosensitive drum 100 with a laser beam based on image information to form an electrostatic image (electrostatic latent image) on the photosensitive drum 100. An intermediate transfer belt 31 serving as an intermediate transfer member for transferring a toner image on the photosensitive drum 100 onto a recording material 120 is arranged to face to four photosensitive drums 100.

The intermediate transfer belt 31 formed of an endless belt serving as an intermediate transfer member abuts on all the photosensitive drums 100, to cyclically move (rotate) in a direction indicated by an arrow B illustrated in FIG. 1 (a counterclockwise direction).

Four primary transfer rollers 32 serving as primary transfer units are arranged side by side on an inner peripheral surface of the intermediate transfer belt 31 to respectively face to the photosensitive drums 100. A bias with a polarity opposite to a normal charge polarity of toner is applied to the primary transfer roller 32 from a primary transfer bias power source (high-voltage power source) serving as a primary transfer bias application unit (not illustrated). Thus, the toner image on the photosensitive drum 100 is transferred (primarily transferred) onto the intermediate transfer belt 31.

A secondary transfer roller 33 serving as a secondary transfer unit is arranged on an outer peripheral surface of the intermediate transfer belt 31. A bias with a polarity opposite to the normal charge polarity of the toner is applied to the second transfer roller 33 from a secondary transfer bias power source (high-voltage power source) serving as a secondary transfer bias application unit (not illustrated). Thus, a toner image on the intermediate transfer belt 31 is transferred (secondarily transferred) onto the recording material 120. When a full color image is formed, for example, the above-described processes are sequentially performed in the image forming units SY, SM, SC, and SK, and toner images in the respective colors are sequentially overlaid on the intermediate transfer belt 31 and primarily transferred. Then, the recording material 120 is conveyed to the secondary transfer unit in synchronization with a movement of the intermediate transfer belt 31. The toner images in the four colors on the intermediate transfer belt 31 are collectively secondarily transferred onto the recording material 120 by the function of the secondary transfer roller 33 that abuts on the intermediate transfer belt 31 via the recording material 120.

The recording material 120 onto which the toner images have been transferred is conveyed to a fixing device 34 serving as a fixing unit. The fixing device 34 fixes the toner images on the recording material 120 by applying heat and pressure to the recording material 120.

[Configuration and Operation of Process Cartridge]

The overall configuration of the process cartridge 70 to be mounted on the image forming apparatus according to the present exemplary embodiment will be described.

Figure 2:
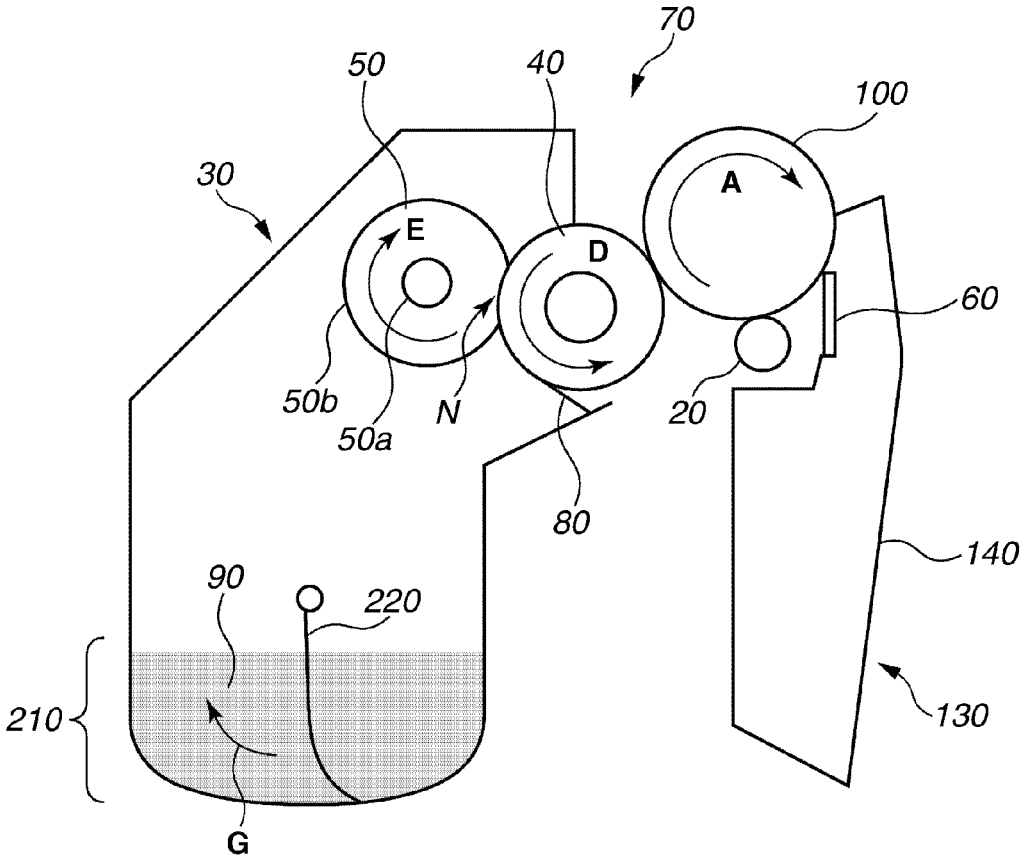
FIG. 2 is a schematic sectional view illustrating a configuration of a developing unit and a process cartridge according to the first exemplary embodiment.
Figure 7:
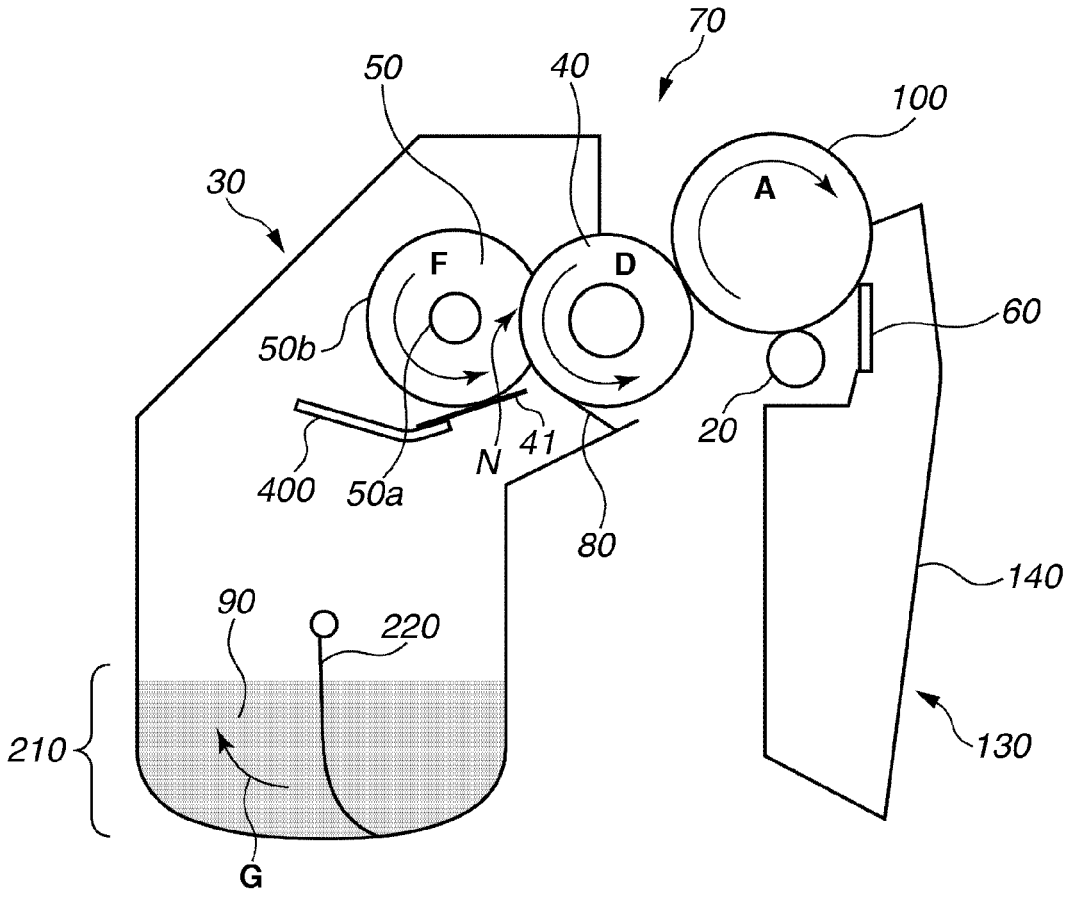
FIG. 7 is a schematic sectional view illustrating a configuration of a process cartridge according to a conventional example.

FIG. 2 is a cross-sectional (main cross-sectional) view of the process cartridge 70 according to the present exemplary embodiment, as viewed in a longitudinal direction (a rotational axis direction) of the photosensitive drum 100. FIG. 2 illustrates an orientation of the process cartridge 70 when the process cartridge 70 is mounted on the image forming apparatus main body, and descriptions of a positional relationship among members constituting the process cartridge 70 and a direction of each of the members are based on a positional relationship and a direction in the orientation in FIG. 7. According to the present exemplary embodiment, configurations and operations of the process cartridges 70 for the respective colors are substantially the same excluding the type (color) of a contained developer.

The process cartridge 70 includes a photoreceptive unit 130 including the photosensitive drum 100 and others and a developing unit 30 including a developing roller 40 and others.

The photosensitive drum 100 is rotatably attached to the photosensitive unit 130 via a bearing (not illustrated). The photosensitive drum 100 is driven to rotate in a direction indicated by an arrow A illustrated in FIG. 2 (a clockwise direction) according to an image forming operation by receiving a driving force of the photosensitive drum driving motor. According to the present exemplary embodiment, the photosensitive drum 100 central to an image forming process is an organic photosensitive drum 100 which is formed by sequentially coating an under coat layer, a carrier generation layer, and a carrier guiding layer each serving as a functional film on an outer peripheral surface of an aluminum cylinder.

A charging roller 20 and a cleaning member 60 are arranged on the photosensitive unit 130 so as to contact a peripheral surface of the photosensitive drum 100. Transfer residual toner which has been removed from the surface of the photosensitive drum 100 by the cleaning member 60 is dropped and contained in a cleaning frame 140.

The charging roller 20 serving as a charging unit is driven by making its conductive rubber roller portion contact the photosensitive drum 100 under pressure. A predetermined direct current (DC) voltage, relative to the photosensitive drum 100, is applied to a core of the charging roller 20 as a charging process. Thus, a uniform dark portion potential (Vd) is formed on the surface of the photosensitive drum 100. A spot pattern of the laser beam emitted according to image data from the above-described scanner unit 150 exposes an area of the photosensitive drum 100. A charge on a surface of the exposed area is lost with a carrier from the carrier generation layer, so that a potential of the exposed area decreases. As a result, an electrostatic latent image having a predetermined light portion potential (Vl) is formed on the exposed area, and an electrostatic latent image having a predetermined dark portion potential (Vd) is formed on an unexposed area of the photosensitive drum 100.

The developing unit 30 includes a toner container for containing a nonmagnetic one-component developer, i.e., toner as a developer. The toner container includes the developing roller 40 serving as a developer bearing member for bearing toner and a toner supply roller (hereinafter merely referred to as a "supply roller") 50 serving as a developer supply member for supplying toner to the developing roller 40. A regulating blade 80 for regulating a toner coat amount of toner on the developing roller 40 which has been supplied by the supply roller 50 and applying a charge to the toner is arranged in the toner container. The regulating blade 80 is a member in the shape of a thin plate, forms an abutment pressure using spring elasticity of the thin plate, and has its surface contacting and abutting on the toner and the developing roller 40. Toner is frictionally charged by sliding friction between the regulating blade 80 and the developing roller 40, and a layer thickness thereof is regulated at the same time the charge is applied thereto. According to the present exemplary embodiment, a predetermined voltage is applied to the regulating blade 80 from a blade bias power source (not illustrated), to stabilize a toner coat.

A toner containing unit 210 is arranged in a direction in which toner scraped off from the developing roller 40 by the regulating blade 80 drops, and contains the toner. A toner conveyance member 220 which is provided in the toner containing unit 210 agitates the toner contained in the toner containing unit 210 and conveys the toner in a direction indicated by an arrow G illustrated in FIG. 2 toward an upper part of the supply roller 50. According to the present exemplary embodiment, the toner conveyance member 220 is driven to rotate at 50 rpm.

The developing roller 40 and the photosensitive drum 100 respectively rotate so that their respective surfaces move in the same direction (a direction directed upward from below according to the present exemplary embodiment) at a facing portion (contact portion) therebetween. The toner conveyance member 220, the developing roller 40, and the supply roller 50 rotate upon receiving a driving force from a developing unit driving motor (not illustrated) provided in the image forming apparatus main body.

While the developing roller 40 is arranged in contact with the photosensitive drum 100 according to the present exemplary embodiment, the developing roller 40 may be closely arranged at a predetermined interval from the photosensitive drum 100.

According to the present exemplary embodiment, toner which has been negatively charged by frictional charging with respect to the predetermined DC bias applied to the developing roller 40 is transferred to only a light portion potential portion at a developing unit contacting the photosensitive drum 100 to visualize an electrostatic latent image due to a potential difference between the developing roller 40 and the photosensitive drum 100.

An arrangement of the supply roller 50 which characterizes the present exemplary embodiment and its rotational direction will be described with reference to FIG. 3.

First, the supply roller 50 rotates with a nip portion N formed between the supply roller 50 and the developing roller 40. The nip portion N is a portion where toner is nipped between the developing roller 40 and the supply roller 50. The supply roller 50 is an elastic sponge roller having a foam layer formed on an outer periphery of its conductive core. The supply roller 50 and the developing roller 40 contact each other by a predetermined amount of intrusion, i.e., a concave amount ΔE which is generated when the developing roller 40 deforms the supply roller 50 in a concave shape in FIG. 3. According to the present exemplary embodiment, the amount of intrusion of the supply roller 50 into the developing roller 40, i.e., the concave amount ΔE generated when the developing roller 40 deforms the supply roller 50 in a concave shape is set to 1 mm.

Figure 3:
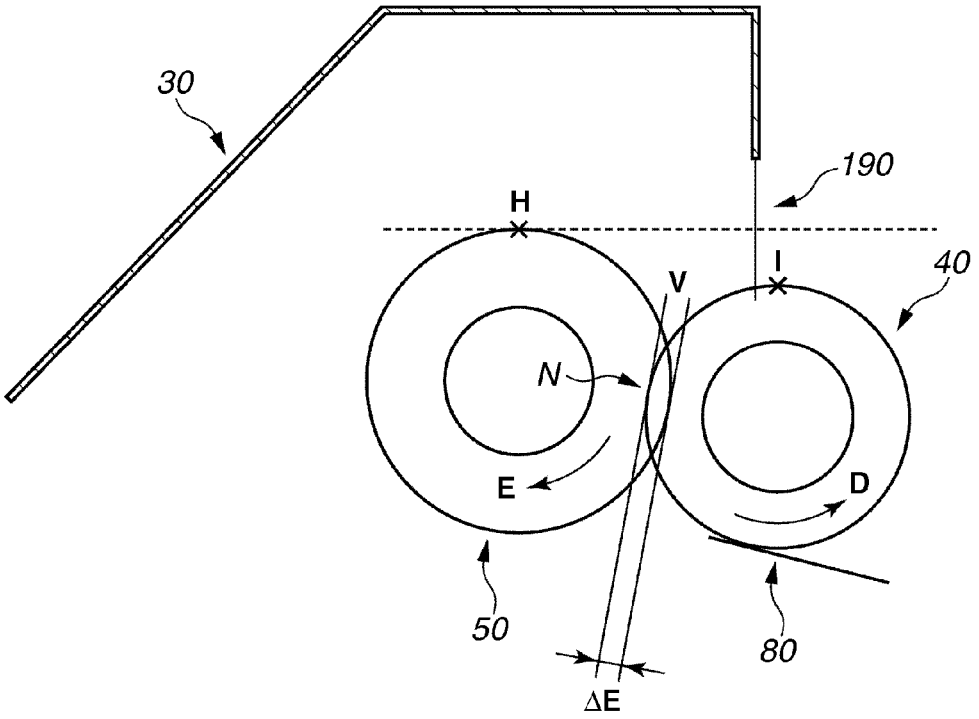
FIG. 3 is an enlarged sectional view illustrating an arrangement of a developer supply member and a developer bearing member according to the first exemplary embodiment.

The supply roller 50 rotates in a direction indicated by an arrow E illustrated in FIG. 3 in the nip portion (facing portion) N between the supply roller 50 and the developing roller 40 so that their respective surfaces move in the same direction. According to the present exemplary embodiment, the developing roller 40 and the supply roller 50 are respectively driven to rotate at 100 rpm and 200 rpm.

A mechanism for forming a toner coat when the supply roller 50 rotates in the direction indicated by the arrow E illustrated in FIG. 3 will be described below.

First, the toner contained in the toner containing unit 210 is splashed by the toner conveyance member 220, and its large part is conveyed to the upper part of the supply roller (the supply member) 50. The toner conveyed to the supply roller 50 remains on a surface and an inside of the supply roller 50. The toner is conveyed right in front of the nip portion N between the supply roller 50 and the developing roller 40 by the rotation of the supply roller 50 in the direction indicated by the arrow E illustrated in FIG. 3. The foam layer on the supply roller 50 is deformed right in front of the nip portion N between the supply roller 50 and the developing roller 40. The deformation causes the toner remaining on the surface and inside of the supply roller 50 to be ejected. The ejected toner is stored in a space above the developing roller 40 and the supply roller 50 (hereinafter referred to as a "temporary toner storage portion V").

A part of the toner stored in the temporary toner storage portion V enters the nip portion N by rotation of the developing roller 40 and the supply roller 50. A charge is applied to the toner which has entered the nip portion N by sliding friction between the developing roller 40 and the supply roller 50. The charged toner is electrostatically adsorbed to the developing roller 40 due to its own charge amount after passing through the nip portion N. Due to the effect, the toner is supplied from the supply roller 50 to the developing roller 40. The regulating blade (regulating member) 80 regulates a part of the toner which has been supplied to the developing roller 40 to form a toner coat having a desired layer thickness on the developing roller 40. The regulated toner drops by gravity and returns to the toner containing unit 210.

As described above, the toner stored in the temporary toner storage portion V is supplied to the developing roller 40 to form the toner coat. More specifically, it is desirable that the temporary toner storage portion V has a configuration capable of storing a desired amount of toner to stably form a toner coat.

Therefore, the supply roller 50 and the developing roller 40 are arranged so that an upper end H in FIG. 3 of the supply roller 50 becomes higher than an upper end I in FIG. 3 of the developing roller 40 in the orientation of the process cartridge 70 during development according to the present exemplary embodiment. In this arrangement, the temporary toner storage portion V is formed in at least a region surrounded by the supply roller 50, the developing roller 40, a skimming sheet 190 or a frame of the developing unit 30, and a tangential line to the supply roller 50 (a dotted line in FIG. 3) which passes through the upper end H of the supply roller 50. Therefore, the volume of the temporary toner storage portion V can be increased. According to the present exemplary embodiment, the size of the temporary toner storage portion V is determined by the outer diameter of the supply roller 50 and the arrangement of the supply roller 50 and the developing roller 40. The size of the temporary toner storage portion V is set to a size in which a sufficient amount of toner to stably form a toner coat is stored, so that the toner coat can be formed more stably.

According to the present exemplary embodiment, an outer diameter of the developing roller 40 is 12 mm, an outer diameter of the supply roller 50 is 15 mm, and the developing roller 40 and the supply roller 50 are arranged so that the upper end H of the supply roller 50 is 5 mm above the upper end I of the developing roller 40.

EXPERIMENT

For the configuration according to the present exemplary embodiment described with reference to FIGS. 1 to 3, density stability of a solid image was evaluated by the following experiment.

As the evaluation of density stability of a solid image, an amount of decrease in image density was measured when an image having a high printing ratio (a solid image) was continuously output. The image forming apparatus was left for one day under an evaluation environment of a temperature of 25.5° C. and a relative humidity (RH) of 50% to adapt to the environment, then the evaluation was performed after the solid image was printed on 100 sheets. The printing test on 100 sheets was performed by continuously feeding sheets to record an image including horizontal lines having an image ratio of 5% through the image forming apparatus. Then, the solid image was output on three consecutive sheets, and the following evaluation was performed using SPECTORDENSITOMETER 500 manufactured by X-Rite from a density difference between a leading edge and a trailing edge of the third sheet on which the solid image was output. The image of the printing test and the evaluation were output in a single color (black).

A: The difference between the densities of the solid image at the leading edge and the trailing edge of the sheet was less than 0.2

B: The difference between the densities of the solid image at the leading edge and the trailing edge of the sheet was 0.2 or more and less than 0.3

C: The difference between the densities of the solid image at the leading edge and the trailing edge of the sheet was 0.3 or more A similar experiment was also performed in the following configuration.

Comparative Example 1

Figure 4:
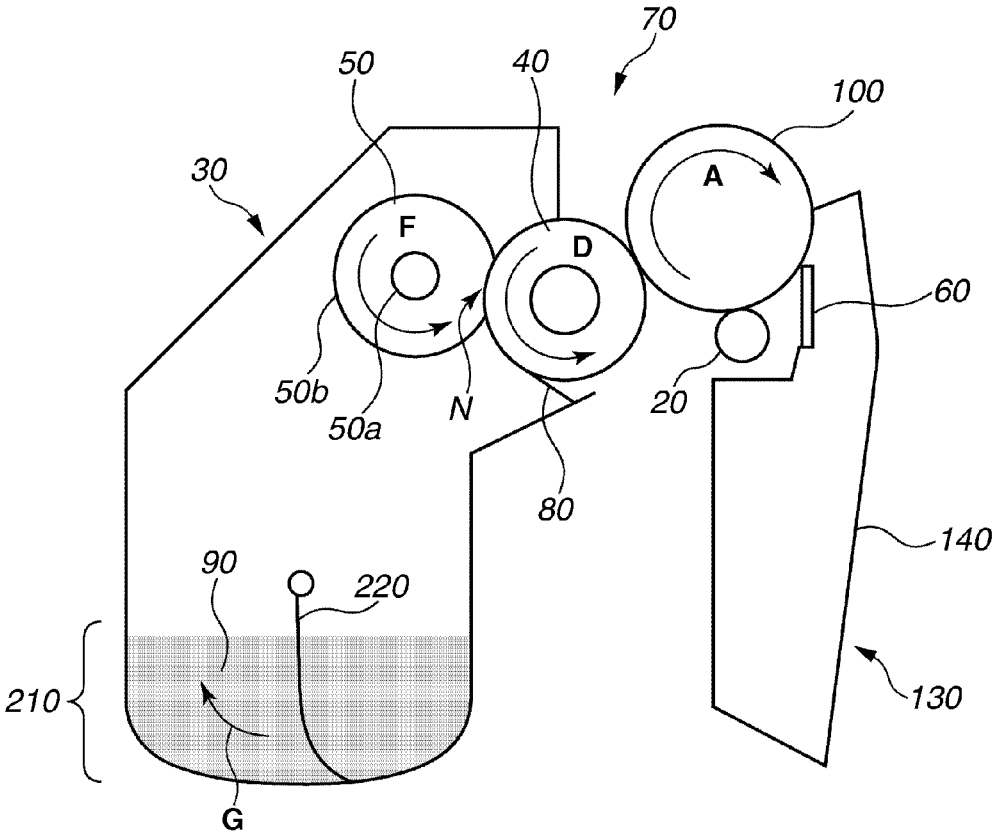
FIG. 4 is a schematic sectional view illustrating a configuration of a process cartridge according to a comparative example 1.

FIG. 4 is a schematic sectional view according to a comparative example 1. As illustrated in FIG. 4, a rotational direction of a supply roller 50 is indicated by an arrow F. In the comparative example 1, the supply roller 50 is driven to rotate at 50 rpm. The other configuration is similar to that according to the first exemplary embodiment. An experiment result is illustrated in Table 1:

TABLE 1

| | Exemplary Embodiment 1 | Comparative example 1 |
|---|---|---|
| Density stability evaluation | A | C |

In the configuration according to the first exemplary embodiment, toner can be stored in the temporary toner storage portion V, and the toner can be efficiently supplied to the developing roller 40. Therefore, the density stability is ensured in the solid image.

On the other hand, in the configuration in the comparative example 1, a large part of the toner which had been conveyed to the upper part of the supply roller 50 by the toner conveyance member 220 is returned to the toner containing unit 210 by rotation of the supply roller 50. Therefore, the toner cannot be stored in the temporary toner storage portion V. As a result, toner cannot be stably supplied to the developing roller 40. Therefore, the solid image decreased in density at its trailing edge.

According to the present exemplary embodiment, the supply roller 50 rotates in a direction in which its surface moves from an upper end to a lower end of the nip portion N in the configuration in which toner is supplied from the toner containing unit 210 arranged below the supply roller 50 to the supply roller 50. Thus, the toner which has been conveyed onto the supply roller 50 from the toner conveyance member 220 can be stored above the nip portion N. Therefore, the decrease in density of the solid image can be suppressed with a simple configuration without requiring an additional member.

According to the present exemplary embodiment, the outer diameter of the developing roller 40 is 12 mm, and the outer diameter of the supply roller 50 is 15 mm, as described above. On the other hand, a similar experiment to the above-described experiment was performed for a configuration in which the outer diameter of the developing roller 40 was 12 mm and the outer diameter of the supply roller 50 was 7 mm. However, a more satisfactory result was obtained when the outer diameter of the supply roller 50 was 15 mm. This result can be caused by an increase in the volume of the temporary toner storage portion V by making the outer diameter of the supply roller 50 larger than the outer diameter of the developing roller 40.

According to the present exemplary embodiment, the developing roller 40 and the supply roller 50 rotate in a direction from the upper end to the lower end of the nip portion N, as described above. Thus, the toner stored in the temporary toner storage portion V is provided for development after being satisfactorily charged by passing through the nip portion N. Therefore, the quality of the image can be improved. Further, according to the present exemplary embodiment, a peripheral speed of the supply roller 50 is made higher than a peripheral speed of the developing roller 40. Accordingly, the toner is rubbed when it passes through the nip portion N, and a large amount of toner which has been satisfactorily charged can be supplied to the developing roller 40.

According to the present exemplary embodiment, toner which has been ejected from the foam layer on the supply roller 50 is stored in the temporary toner storage portion V and contributes to the decrease in density of the solid image. However, the foam layer is not a component essential in producing the effect of the present invention. More specifically, if the supply roller 50 forming the nip portion N between the supply roller 50 and the developing roller 40 rotates in the direction from the upper end to the lower end of the nip portion N, the toner supplied from the toner conveyance member 220 is stored above the nip portion N so that the decrease in density of the solid image can be suppressed in a simple configuration.

A second exemplary embodiment will be described below. In the following descriptions, description of similar parts to those in the above-described first exemplary embodiment is not repeated.

Figure 5:
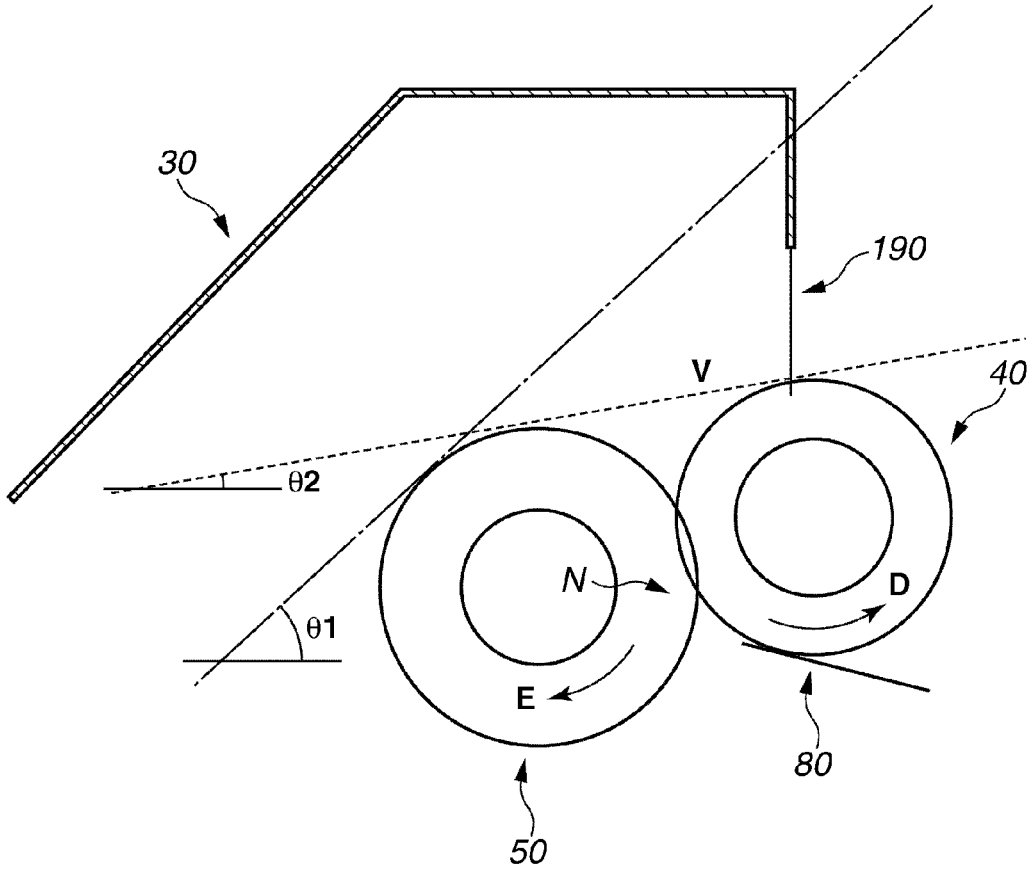
FIG. 5 is an enlarged sectional view illustrating an arrangement of a developer supply member and a developer bearing member according to a second exemplary embodiment.

In the second exemplary embodiment, a supply roller 50 and a developing roller 40 are installed so that an upper end of the supply roller 50 is below an upper end of the developing roller 40 as illustrated in FIG. 5. This arrangement has the advantages that the height from the toner containing unit 210 to the upper part of the supply roller 50 can be decreased and an amount of toner which reaches the upper part of the supply roller 50 by the toner conveyance member 220 can be increased.

The temporary toner storage portion V according to the present exemplary embodiment is a region surrounded by the supply roller 50, the developing roller 40, a frame of the developing unit 30, and a tangential line to the supply roller 50 (indicted by a alternate long and short dash line in FIG. 5) which forms an angle matching a repose angle θ1 with a horizontal line. More specifically, in a situation where the repose angle θ1 of toner to be used is determined, the size of the temporary toner storage portion V is determined by respective outer diameters of the supply roller 50 and the developing roller 40 and an arrangement of the supply roller 50 and the developing roller 40.

Figure 6:
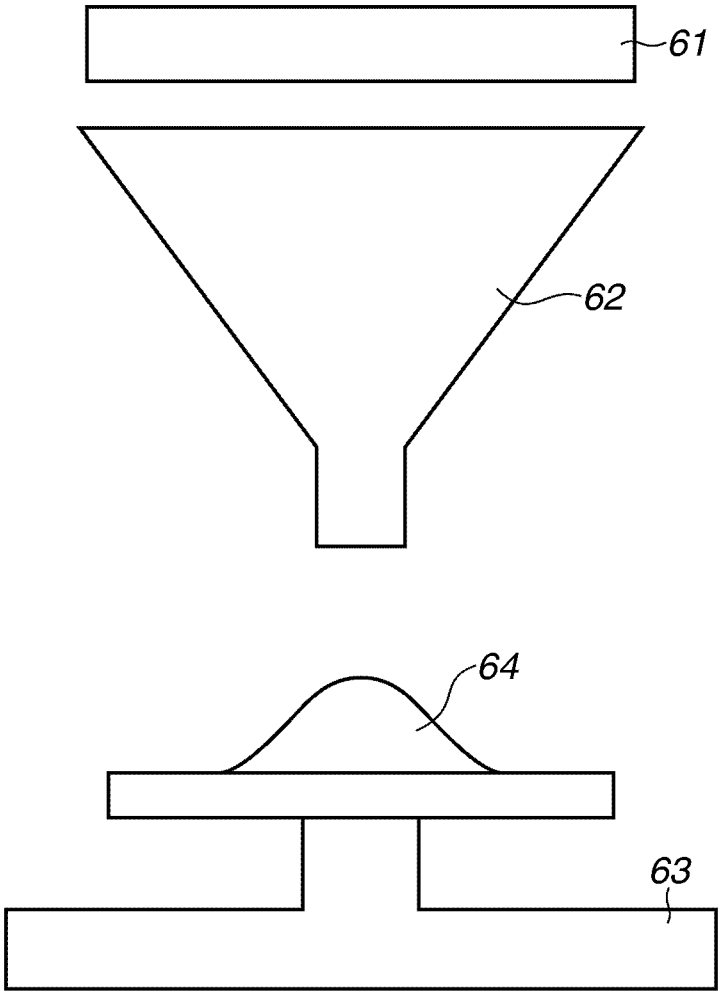
FIG. 6 illustrates a method for measuring a repose angle.

A method for measuring a repose angle according to the present exemplary embodiment will be described below with reference to FIG. 6.

As a measurement device for measuring the repose angle according to the present exemplary embodiment, POWDER TESTER PT-S (HOSOKAWA MICRON CORPORATION) was used. A measurement method conformed to an instruction manual attached to POWDER TESTER PT-S (an aperture of a sieve 61: 710 μm, a vibration time: 180 seconds, amplitude: 2 mm or less). Toner was dropped on a disk 63 from a funnel 62. An angle between a generatrix of toner 64 deposited in a conical shape on the disk 63 and a surface of the disk 63 was found as a repose angle. The measurement of a repose angle of the sample was repeated five times by the measurement device under an environment of a temperature of 23° C. and a relative humidity (RH) of 50%, and a repose angle θ1 was obtained by calculating an arithmetic average of the measurement results. The repose angle θ1 of the toner 64 used according to the present exemplary embodiment was 39.3°.

A relationship between the arrangement of the supply roller 50 and the developing roller 40 and the temporary toner storage portion V will be described below. According to the present exemplary embodiment, an angle θ2 between a common tangential line on the upstream side of rotation (the upper common tangential lines to the supply roller 50 and the developing roller 40) and a horizontal line was used as a value representing a relationship between the supply roller 50 and the developing roller 40.

For a configuration of the present exemplary embodiment, the size of the temporary toner storage portion V was changed by changing the outer diameter of the supply roller 50 and the arrangement of the supply roller 50, to evaluate density stability of a solid image similar to that according to the first exemplary embodiment. The experiment was conducted by using four types of supply rollers 50 respectively having outer diameters of 5 mm, 10 mm, 15 mm, and 20 mm, and arranging each of the supply rollers 50 so that the angle θ2 was 10°, 25°, 40°, 45°, and 60°, respectively. Experiment results were illustrated in Table 2:

TABLE 2

| | | θ2 [°] | | | | |
|---|---|---|---|---|---|---|
| | | 10 | 25 | 40 | 45 | 60 |
| Outer diameter of supply roller [mm] | 5 | A | A | A | B | C |
| | 10 | A | A | A | B | C |
| | 15 | A | A | A | A | C |
| | 20 | A | A | A | A | C |

First, the larger the outer diameter of the supply roller 50 was, the larger the volume of the temporary toner storage portion V became. Therefore, a toner supply capability to the developing roller 40 was improved. Thus, a decrease in density at a trailing edge of a solid image was more suppressed than when the outer diameter of the supply roller 50 was small.

When the angle θ2 was smaller than the repose angle θ1 of toner, an amount of toner which can be stored in the temporary toner storage portion V was increased and the decrease in density at the trailing edge of the solid image was more suppressed than when the angle θ2 was larger than the repose angle θ1 of the toner.

When θ2=60°, the density decreased at the trailing edge of the solid image. However, the decrease in density was more relatively suppressed than a case where θ=60° and the rotational direction of the supply roller 50 is set to a direction from a lower end to an upper end of a nip portion N. More specifically, in both the configurations according to the first exemplary embodiment and according to the second exemplary embodiment, the effect of the present invention can be produced by setting the rotational direction of the supply roller 50 to the direction from the upper end to the lower end of the nip portion N.

The first and second exemplary embodiments are described above. While the image forming apparatus capable of forming a color image is describe as an example of the above-described exemplary embodiments, the present invention is not limited to this. The present invention may be applied to an image forming apparatus capable of forming a monochrome image, in which case a similar effect can be obtained.

While a printer is described as an example of the image forming apparatus in the above-described exemplary embodiments, the present invention is not limited to this. The present invention may be applied to other image forming apparatuses such as a copying machine and a facsimile apparatus, other image forming apparatuses such as a multifunction peripheral with combinations of their functions, or an image forming apparatus using a recording material bearing member for sequentially overlaying and transferring toner images in respective colors on a recording material borne by the recording material bearing member onto the recording material, in which case a similar effect can be obtained.

[Overall Configuration of Image Forming Apparatus and Outline of Operation]

Figure 8:
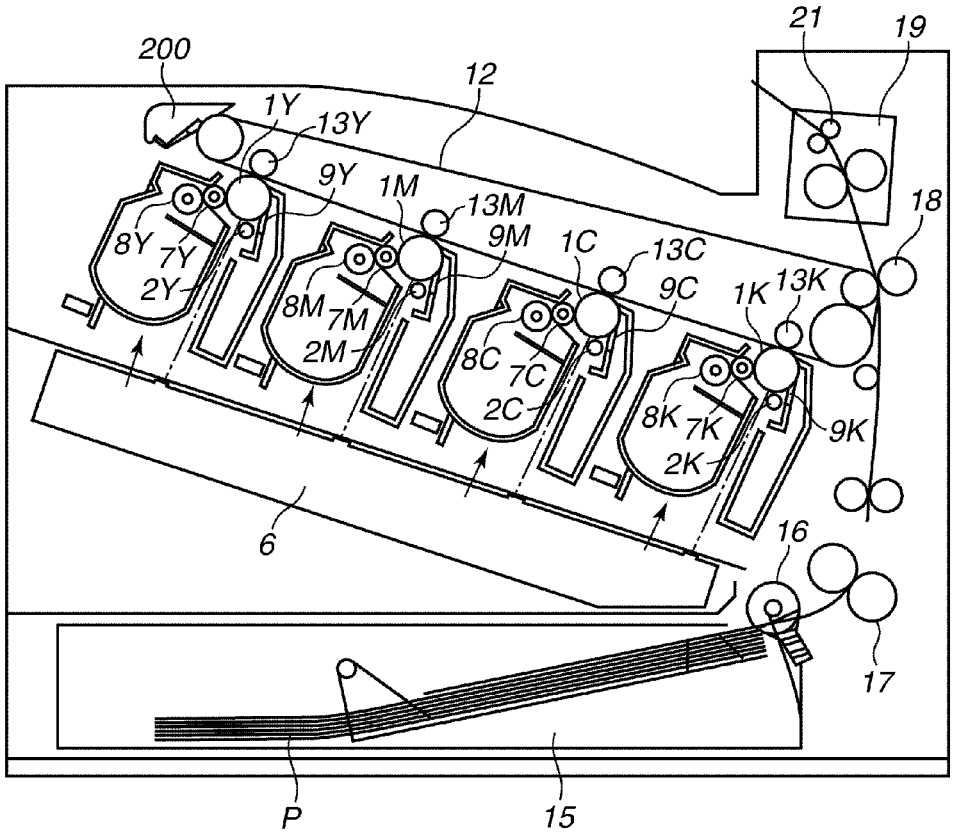
FIG. 8 is a schematic sectional view illustrating a configuration of an image forming apparatus according to each of third and fourth exemplary embodiments.

FIG. 8 is a schematic view illustrating a configuration of an image forming apparatus according to a third exemplary embodiment.

A photosensitive drum 1 is a rotating drum type electrophotographic photosensitive member serving as an image bearing member. According to the present exemplary embodiment, the photosensitive drum 1 is a negatively-charged organic photosensitive member, and is driven to rotate at a predetermined peripheral speed in a clockwise direction indicated by an arrow by a driving motor (not illustrated). The photosensitive drum 1 is uniformly charged by a charging device to a predetermined negative potential in its rotation process. According to the present exemplary embodiment, the charging device is a contact charging device using a charging roller 2 as a charging member. The charging roller 2 is driven by the photosensitive drum 1 to rotate. A bias voltage is applied to the charging roller 2 from a charging bias power source (not illustrated), to uniformly charge the photosensitive drum 1.

An exposure device 6 then subjects the photosensitive drum 1 to image exposure. The exposure device 6 forms an electrostatic latent image on the photosensitive drum 1 uniformly charged, and uses a semiconductor laser scanner for exposure according to the present exemplary embodiment. The exposure device 6 outputs a laser beam which has been modulated to match an image signal transmitted from a host device (not illustrated) in the image forming apparatus, and subjects a uniformly charged surface of the photosensitive drum 1 to scanning exposure (image exposure). Electrostatic latent images corresponding to image information are sequentially formed on the photosensitive drum surface when an absolute value of a potential in an exposed area becomes lower than an absolute value of a charging potential.

The electrostatic latent image is then developed by a developing unit 10*b* (a developing device) and visualized as a toner image. According to the present exemplary embodiment, a contact development method is used. In the contact development method, toner charged to a negative polarity in a contact area between a supply roller 8 and the developing roller 7 and a contact area between a regulating blade 11 and the developing roller 7 is applied to the electrostatic latent image on the photosensitive drum surface by applying a DC development bias voltage to the developing roller 7 from the development bias power source, so that the electrostatic latent image is reversely developed.

A positive-polarity transfer bias voltage is then applied to a primary transfer roller 13 from a transfer bias power source (not illustrated). Thus, the toner charged to the negative polarity on the photosensitive drum 1 is transferred onto an intermediate transfer member 12 that is rotating and moving in a direction indicated by an arrow. A secondary transfer roller 18 pressed by an urging unit such as a pressing spring in a secondary transfer portion transfers a toner image onto a recording material P such as paper which has been fed from a sheet cassette 15.

A cleaning blade 9 scrapes transfer residual toner from the photosensitive drum 1 which has been separated from the intermediate transfer member 12 to clean the photosensitive drum surface and the processing proceeds to the charging process again. The cleaning blade 9 according to the present exemplary embodiment collects the transfer residual toner which has not completely been transferred onto the transfer member 12 from the photosensitive drum 1 during a transfer process, and abuts on the photosensitive drum 1 at a predetermined pressure and cleans the photosensitive drum surface by collecting the transfer residual toner. Similarly, an intermediate transfer member cleaning device 200 scrapes transfer residual toner on the transfer member 12 after secondary transfer, to clean the photosensitive drum surface, and the processing proceeds to the transfer process again.

In sheet feeding, a pickup roller 16 and a sheet feeding roller 17 in the sheet cassette 15 are driven to rotate in a predetermined control timing. Thus, recording materials P stacked and stored in the sheet cassette 15 are separated one at a time and fed to the sheet feeding roller 17. The sheet feeding roller 17 conveys the recording material P to the secondary transfer roller 18 in synchronization with a timing at which the toner image reaches the secondary transfer portion.

The recording material P on which the toner image has been transferred is separated from the photosensitive drum surface, and is guided into a fixing device 19 and subjected to toner image fixing processing therein. The fixing device 19 fixes the toner image transferred onto the recording material P with use of heat, pressure, and the like.

The recording material P passed through the transfer roller 13 is separated from the photosensitive drum surface and is guided into the fixing device 19. The fixing device 19 fixes the toner image which has not yet been fixed by the fixing device 19 as a fixed image on the recording material P using heat and pressure. A discharge roller 21 discharges the recording material P which has left the fixing device 19 as a print to a discharge tray outside the image forming apparatus.

The image forming apparatus uses the above-described units, and repeats the processes such as charging, exposure, development, transfer, fixing, and cleaning, to perform image formation.

While a method which can suppress a ghost image without applying special processing on a surface of a developer bearing member in the present invention in the image forming apparatus will be described in detail below, the present invention is not limited to only the exemplary embodiment described below.

Specific Description of Present Exemplary Embodiment

Figure 9:
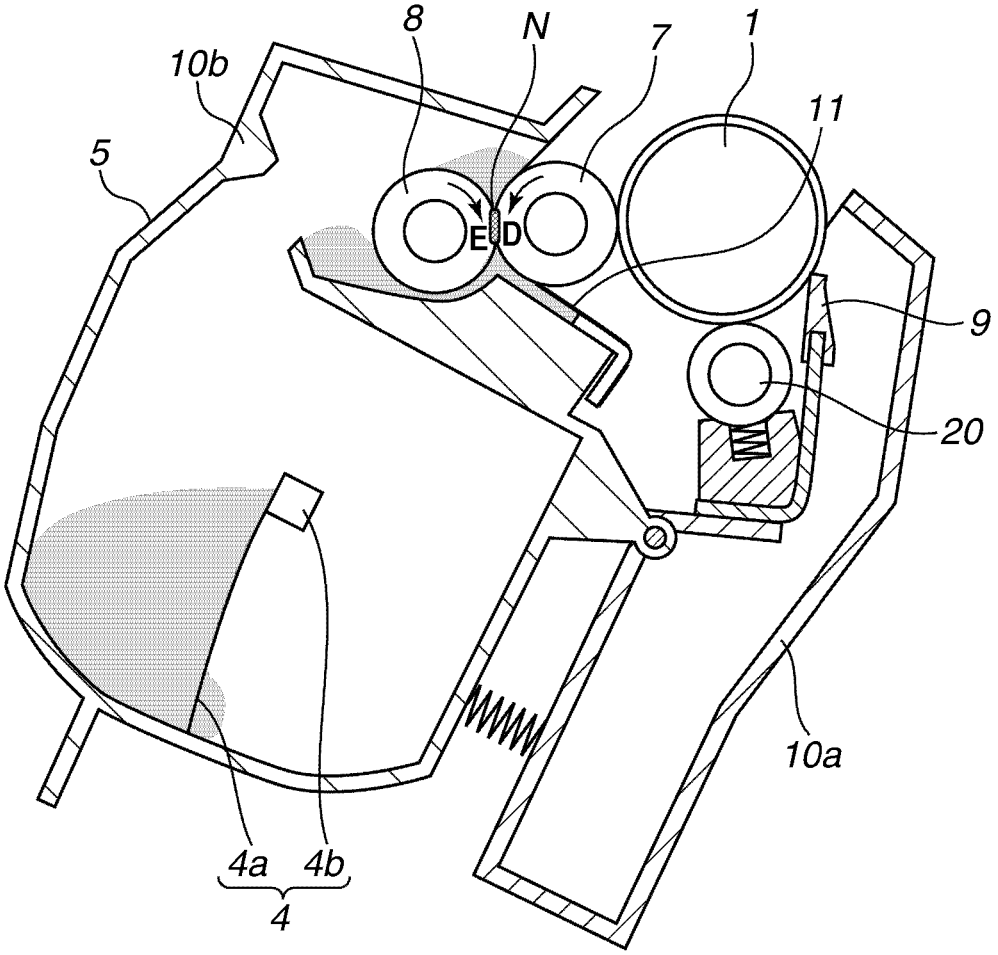
FIG. 9 is a schematic sectional view illustrating a configuration of a process cartridge according to each of the third and fourth exemplary embodiments.

FIG. 9 is a cross-sectional (main cross-sectional) view of a process cartridge according to the present exemplary embodiment as viewed along a longitudinal direction (a rotational axis direction) of the photosensitive drum 1. According to the present exemplary embodiment, configurations and operations of the process cartridges for the respective colors are substantially the same excluding the type (color) of a contained developer.

The process cartridge includes a photosensitive unit 10*a* including the photosensitive drum 1 and others and a developing unit 10*b* including a developing roller 7 and others, and is detachably attached to an image forming apparatus main body. The process cartridge includes the developing roller 7 serving as a developer bearing member facing to the photosensitive drum 1 by exposing a part of its peripheral surface from an opening of a development container, a supply roller 8 serving as a developer supply member, and a regulating blade 11 serving as a regulating member for regulating a layer thickness of a developer. A developer agitation/conveyance member 4 including an agitation sheet 4*a* and an agitation bar 4*b* is provided in the development container 5, and conveys the developer within the development container 5 onto the supply roller 8. The developing roller 7 and the supply roller 8 form a nip portion N therebetween, and rotate so that their respective surfaces move in the same direction in the nip portion N (a direction from an upper end to a lower end of the nip portion N).

In the process cartridge according to the present exemplary embodiment, toner contained in the development container 5 is nonmagnetic one-component polymerization toner. In the toner, a coloring agent, a mold release agent, a polarity controlling agent, and the like are dispersed in its base resin. In addition, external additives are scattered on a surface of the base resin for the toner to have a fluid function. The toner is charged to a negative polarity by frictional charging. The toner is mechanically pumped and supplied to a surface of the supply roller 8 while being agitated at a rotational speed of 50 rpm by the agitation sheet 4*a*, and a large part of the toner is conveyed to the upper part of the supply roller 8. The toner which has been conveyed to the supply roller 8 remains on the surface and inside of the supply roller 8. The toner is conveyed right in front of the nip portion N between the supply roller 8 and the developing roller 7 by rotation of the supply roller 8 in a direction indicated by an arrow E illustrated in FIG. 9. A foam layer provided on the surface of the supply roller 8 is deformed right in front of the nip portion N between the supply roller 8 and the developing roller 7, and the toner remained on the surface and inside of the foam layer is ejected due to the deformation. The ejected toner is stored in a space above the developing roller 7 and the supply roller 8 (hereinafter referred to as a "temporary toner storage portion").

A part of the toner stored in the temporary toner storage portion enters the nip portion N by rotation of the developing roller 7 and the supply roller 8. A charge is applied to the toner entered the nip portion N by sliding friction between the developing roller 7 and the supply roller 8. The charged toner is electrostatically adsorbed to the developing roller 7 due to its own charge amount after passing through the nip portion N. Due to the effect, the toner is supplied from the supplying roller 8 to the developing roller 7. A part of the toner which has been supplied to the developing roller 7 is regulated by the regulating blade 11 to form a toner coat having a desired layer thickness on the developing roller 7. A part of the toner is rubbed with a surface of the developing roller 7 and a surface of the regulating blade 11 by being nipped between the developing roller 7 and the regulating blade 11, and frictionally charged to a desired polarity. The regulated toner part drops by gravity and rotation of the developing roller 7 in a direction indicated by an arrow D, while a thin toner layer on the developing roller 7 is conveyed to a development region facing to the photosensitive drum 1.

In the development region, the toner layer on the developing roller 7 is transferred to an electrostatic latent image on the photosensitive drum 1 by a development electric field, and the electrostatic latent image is visualized as a toner image. The toner image is then separated from the photosensitive drum 1 to reach an intermediate transfer member 12, and a cleaning blade 9 scrapes transfer residual toner from the photosensitive drum 1 to clean the photosensitive drum surface, and the processing proceeds to the charging process again. The toner layer remaining on the developing roller 7 without being used for development in the development region is scraped from the developing roller 7 at an abutment portion between the developing roller 7 and the supply roller 8. Simultaneously, toner is newly supplied onto the developing roller 7 by rotation of the supply roller 8. On the other hand, the toner which has been scraped by the supply roller 8 is returned into the development container 5 by rotation of the supply roller 8, and is agitated and mixed within the development container 5.

The regulating blade 11 has its tip directed toward the downstream side of the abutment portion between the developing roller 7 and the supply roller 8, and the tip of the regulating blade 11 abuts on the abutment portion as illustrated in FIG. 9. A part of the toner which is not required to form a thin layer and nipped between the regulating blade 11 and the developing roller 7 is stripped from the developing roller 7 so that a thin layer having a uniform thickness is formed in which a toner loaded amount per unit area (hereinafter referred to as M/S) is in a target range of 0.2 to 0.6 [mg/cm$^2$]. According to the present exemplary embodiment, a stainless steel (SUS) plate having a thickness of 0.1 mm is used for the regulating blade 11.

The developing roller 7 is a conductive rubber roller having an outer diameter of Φ15 mm in which conductive rubber is formed in a roll shape around its iron core and rotates in the direction indicated by the arrow D at 100 rpm. More specifically, the developing roller 7 rotates in a forward direction relative to the photosensitive drum 1. The foam layer on the surface of the supply roller 8 is composed of a polyurethane foam, for example, and can easily retain toner using a cell having a diameter of 50 to 500 μm. The outer diameter of the supply roller 8 is Φ15 mm. The supply roller 8 desirably has an ASKER-F hardness of 50° to 80° to more uniformly abut on the developing roller 7. A resistance value of the supply roller 8 is $1.0\times10^8$. The resistance value was calculated from a current value obtained when a stainless cylindrical member having an outer diameter of 30 mm is brought into contact with the supply roller 8 to face to each other and a DC voltage of 100 V is applied between a core of the supply roller 8 and the stainless cylindrical member. A measurement environment was a temperature of 23.0° C. and a relative humidity (RH) of 50%. The supply roller 8 rotates at 200 rpm, and the surface of the supply roller 8 moves in the same direction as the surface of the developing roller 7 in the nip portion N. An amount that the supply roller 8 cuts into the developing roller 7 is set to 1.0 mm.

Regarding a peripheral speed ratio of the developing roller 7 to the supply roller 8, a configuration in which the ratio of the peripheral speed $V_{DR}$ of the developing roller 7 to a peripheral speed $V_{RS}$ of the supply roller 8 satisfies $2.0<V_{RS}/V_{DR}$ has been considered to increase a supply amount of toner. However, the number of times of repeated sliding friction of the toner is large between the developing roller 7 and the supply roller 8, so that filming and a streak easily occur due to toner deterioration in the latter half of duration. Accordingly, the peripheral speed ratio $V_{RS}/V_{DR}$ can be 2.0 or less.

As a result of deliberate consideration of the above-described issue, a ghost caused by toner which has been non-uniformly charged due to a scraping property decreases can be corrected by increasing the supply amount of the toner to keep an amount of a toner coat on the developing roller 7 constant. The filming and the streak can be solved by decreasing the peripheral speed ratio.

Figure 10:
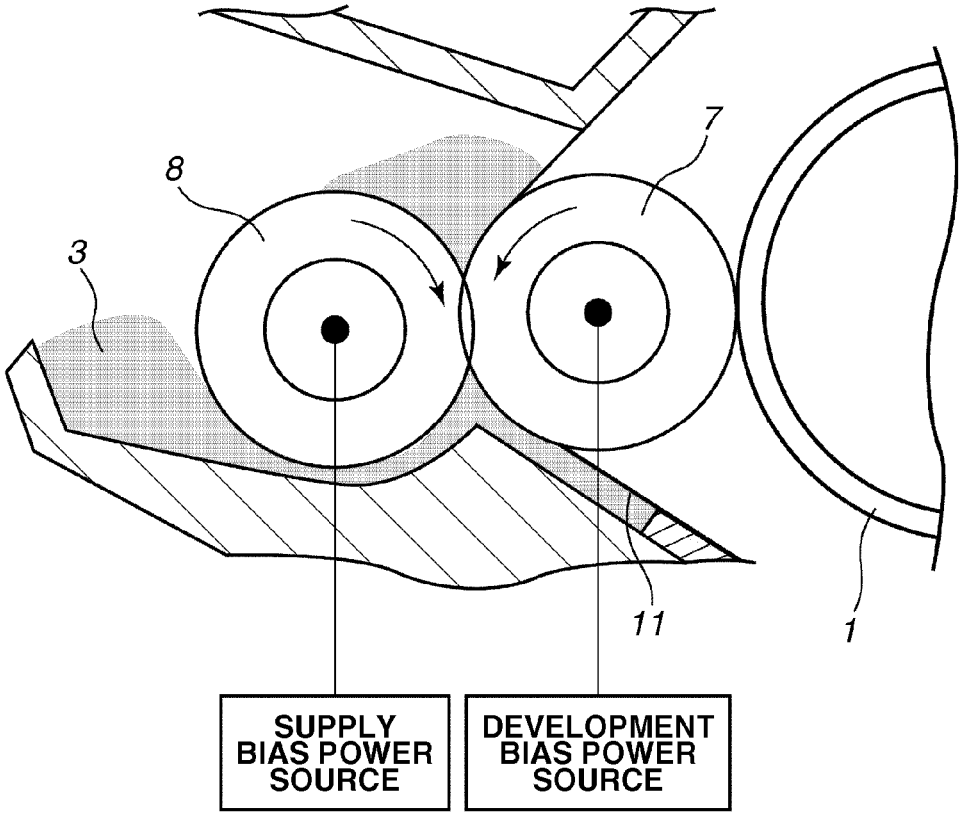
FIG. 10 is a connection diagram for applying a supply bias from a supply bias power source.

FIG. 10 illustrates a configuration in which DC bias voltages are respectively applied to the supply roller 8 and the developing roller 7. The DC bias voltages are respectively applied to the developing roller 7 and the supply roller 8 from a development bias power source (a first voltage application device) and a supply bias power source (a second voltage application device). A supply bias and a development bias are the same in polarity as a charge polarity of toner. The supply bias is set higher than the development bias, so that a supply amount of the toner is increased by an electric field between the supply roller 8 and the developing roller 7. The larger a charge amount of the toner is, the larger the effect of increasing the toner supply amount is.

Figure 11:
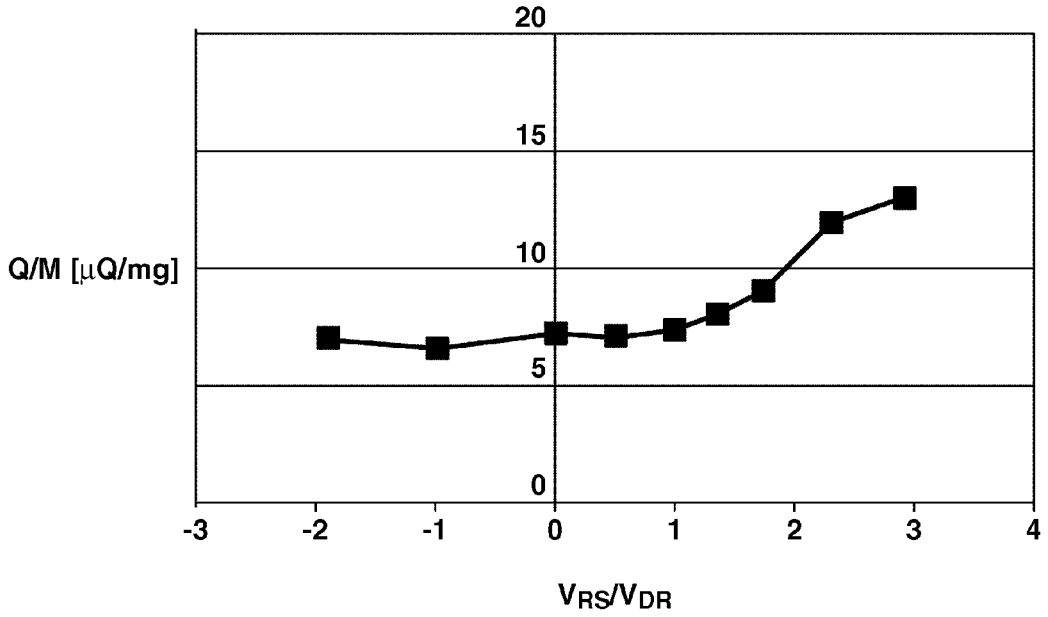
FIG. 11 illustrates a relationship between a toner charge amount on a developing roller which has been rubbed with a supply roller and a difference in peripheral speed between the developing roller and the supply roller.

FIG. 11 illustrates a relationship between a charge amount of toner on the developing roller 7 after sliding friction of the developing roller 7 with the supply roller 8 and a difference in peripheral speed. A range of $V_{RS}/V_{DR}<0$ represents a rotational state where the developing roller 7 and the supply roller 8 rotate so that their respective surfaces move in opposite directions in the nip portion N (hereinafter referred to as counter rotation). $V_{RS}/V_{DR}=0$ represents a state where the supply roller 8 is stopped. A range of $0<V_{RS}/V_{DR}<1.0$ represents a rotational state where the developing roller 7 and the supply roller 8 rotate (rotate in a forward direction) so that their respective surfaces move in the same direction in the nip portion N at a low speed. A range of $1.0<V_{RS}/V_{DR}$ represents a state where the supply roller 8 rotates in a forward direction at a higher speed than that of the developing roller 7.

As can be seen from FIG. 11, a charge amount per unit mass (hereinafter referred to as Q/M) of toner hardly changes even if the difference in peripheral speed changes in the range of $V_{RS}/V_{DR}<1.0$, while the Q/M greatly increases as the difference in peripheral speed increases in the range of $1.0<V_{RS}/V_{DR}$. This is because, in the case of the counter rotation ($V_{RS}/V_{DR}<0$) or the forward rotation in the range of $0<V_{RS}/V_{DR}<1.0$, toner ejected from inside a sponge of the supply roller 8 is mainly supplied to the developing roller 7, whereas in the case of the forward rotation in the range of $1.0<V_{RS}/V_{DR}$, toner deposited on the nip portion N between the developing roller 7 and the supply roller 8 is mainly supplied to the developing roller 7 after being drawn into the nip portion N and sufficiently rubbed therewith. Thus, the Q/M rapidly increases in the range of $1.0<V_{RS}/V_{DR}$ according to a difference in the toner supply process.

Therefore, the supply roller 8 and the developing roller 7 are rotated in the forward direction in the range of $1.0\leq V_{RS}/V_{DR}$, so that the charge amount of the toner increases and the supply amount of the toner can be increased using the supply bias more effectively.

In addition, it is desirable to set the peripheral speed ratio smaller to suppress toner deterioration. Therefore, a method for decreasing the peripheral speed ratio has been considered by using the supply bias at an optimum applied voltage value. The applied voltage value of the supply bias according to the present exemplary embodiment will be described with reference to FIG. 12.

Figure 12:
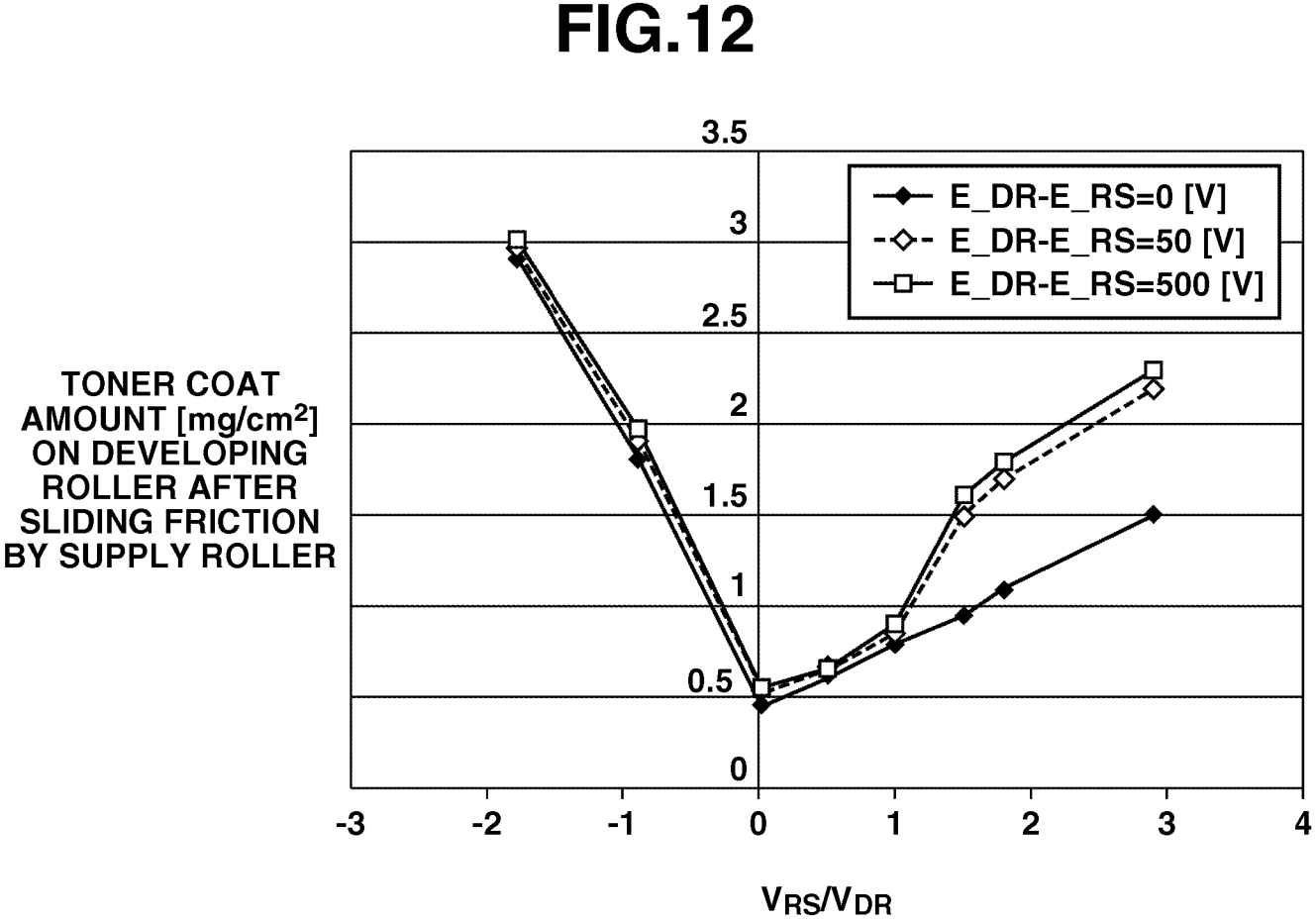
FIG. 12 illustrates an amount of a toner coat on a developing roller which has been rubbed with a supply roller relative to the ratio of respective peripheral speeds of the developing roller and the supply roller.

FIG. 12 illustrates an amount of a toner coat on the developing roller 7 at a position after sliding friction with the supply roller 8 and before regulation by the regulating blade 11 relative to a peripheral speed ratio between the developing roller 7 and the supply roller 8. As illustrated in FIG. 12, in a state that no supply bias is applied, the amount of the toner coat on the developing roller 7 after sliding friction with the supply roller 8 is below 1.0 [mg/cm$^2$] in the range of $1.0\leq V_{RS}/V_{DR}<1.5$. If a solid image is developed in this state, the amount of the toner coat on the developing roller 7 differs between the first round and the second round of the developing roller 7, so that a ghost image easily appears. On the other hand, if the amount of the toner coat on the developing roller 7 is 1.0 [mg/cm$^2$] or more, the occurrence of the ghost image can be more effectively suppressed. For the amount of the toner coat on the developing roller 7 after sliding friction with the supply roller 8 to be 1.0 [mg/cm$^2$] or more, a difference between a DC bias $E_{DR}$ to be applied to the developing roller 7 and a DC bias $E_{RS}$ to be applied to the supply roller 8 is desirably set to satisfy $E_{DR}-E_{RS}>50$. Even if $E_{DR}-E_{RS}>500$, no further effect can be confirmed. The present exemplary embodiment employs a configuration in which $E_{DR}=-300$ V, $E_{RS}=-500$ V, $E_{DR}-E_{RS}=200$ V, and $V_{RS}/V_{DR}=1.4$ after reflecting a change in a charge amount of toner with use of the developing device.

When an amount of intrusion X mm of the supply roller 8 into the developing roller 7 and the thickness d mm of the foam layer on the supply roller 8 are set to satisfy 0.25 mm<X mm<1.8 mm<d mm, a pressure to be applied to the toner decreases between the supply roller 8 and the developing roller 7. Therefore, toner deterioration by friction can be further reduced. The amount of intrusion means a value indicating how the outer diameter (virtual outer diameter) of an RS roller (supply roller) intrudes into the outer diameter of the developing roller 7, and is found by subtracting a center distance between the developing roller 7 and the RS roller from the sum of the radius of the developing roller 7 and the radius of the RS roller.

As described above, according to the present exemplary embodiment, the developing roller 7 and the supply roller 8 rotate so that the surface of the developing roller 7 and the surface of the supply roller 8 move in the same direction in the nip portion N, and a voltage obtained by subtracting the voltage $E_{RS}$ from the voltage $E_{DR}$ is opposite in polarity to the normal charge polarity of the toner. Thus, the effect of balancing stability of a solid image and suppression of the toner deterioration can be obtained while suppressing the occurrence of a ghost image. Therefore, a high-quality image can be formed from the beginning to the end of the use of the developing device. Further, the ratio of the peripheral speed $V_{DR}$ of the developing roller 7 to the peripheral speed $V_{RS}$ of the supply roller 8 is set to satisfy $1.0\leq|V_{RS}/V_{DR}|<2.0$, to greatly improve a charging property of the toner, so that the above-described effect can be made exceptional. Furthermore, the difference between the voltage $E_{DR}$ and the voltage $E_{RS}$ is set to satisfy $50\leq|E_{DR}-E_{RS}|\leq500$ to increase the toner coat amount, so that the effect of balancing stability of the solid image and suppression of the toner deterioration can be obtained while suppressing the occurrence of the ghost image.

In an image forming apparatus according to a fourth exemplary embodiment, a resistance value of a supply roller 8 is $8\times10^6\Omega$ or less, and a relationship between a DC bias $E_{DR}$ to be applied to a developing roller 7 and a DC bias $E_{RS}$ to be applied to the supply roller 8 is set to satisfy $E_{RS}\leq E_{DR}$ in the image forming apparatus according to the third exemplary embodiment.

For an overall configuration of the image forming apparatus and a configuration of a process cartridge according to the present exemplary embodiment, schematic descriptions of similar parts to those in the third exemplary embodiment are not repeated.

Figure 13:
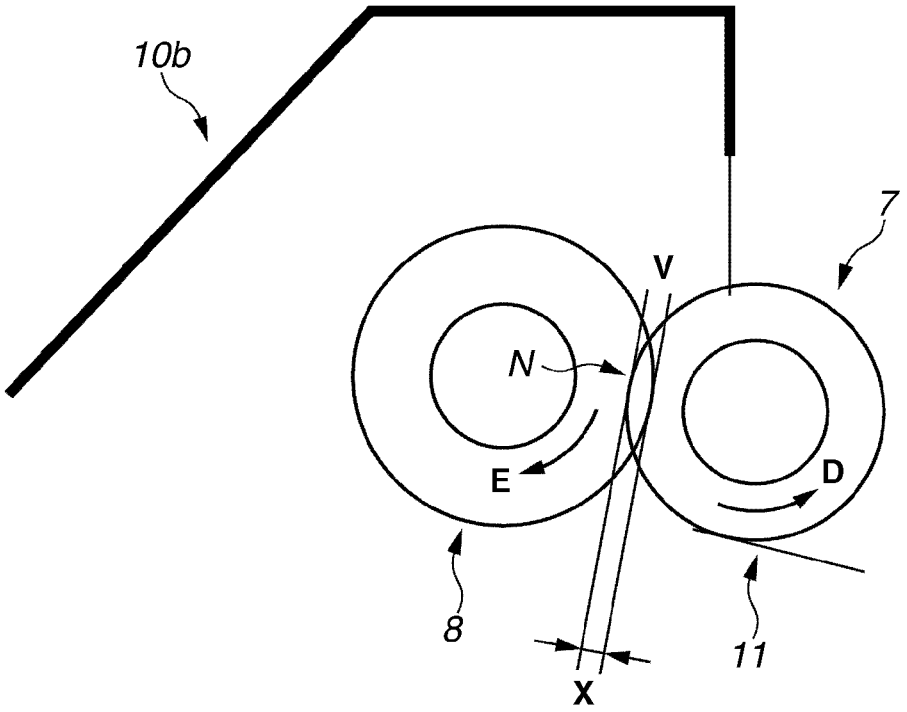
FIG. 13 is an enlarged sectional view illustrating an arrangement of a developer supply member and a developer bearing member according to the fourth exemplary embodiment.

Before describing a detailed configuration of the present exemplary embodiment, an arrangement of the supply roller 8 and its rotational direction according to the present exemplary embodiment and a mechanism for forming a toner coat on the developing roller 7 according to the present exemplary embodiment will be described with reference to FIGS. 9 and 13.

The supply roller 8 is arranged so as to form a predetermined contact portion (nip portion) N on a peripheral surface of the developing roller 7. The supply roller 8 is an elastic sponge roller having a foam layer formed on the outer periphery of its conductive core. The supply roller 8 intrudes into the developing roller 7 by 1 mm to contact the developing roller 7. The supply roller 8 is set to rotate in a direction indicated by an arrow E illustrated in FIGS. 9 and 13. In a facing portion (contact portion) between the supply roller 8 and the developing roller 7, their respective surfaces move in the same direction.

The toner coat formation mechanism in the configuration according to the present exemplary embodiment will be described below. Toner contained in a toner containing unit is splashed by an agitation sheet 4*a*, and its large part is conveyed to the upper part of the supply roller 8. The toner which has been conveyed to the supply roller 8 remains on a surface and inside of the supply roller 8. The toner is conveyed right in front of the nip portion N between the supply roller 8 and the developing roller 7 by the rotation of the supply roller 8 in the direction indicated by the arrow E illustrated in FIGS. 9 and 13. The supply roller 8 is deformed right in front of the nip portion N between the supply roller 8 and the developing roller 7. The deformation causes the toner remaining on the surface and inside of the supply roller 8 to be ejected. The ejected toner is stored in a space above the developing roller 7 and the supply roller 8 (hereinafter referred to as a "temporary toner storage portion V").

A part of the toner stored in the temporary toner storage portion V enters the nip portion N by rotation of the developing roller 7 and the supply roller 8. A charge is applied to the toner which has entered the nip portion N by sliding friction between the developing roller 40 and the supply roller 50. The charged toner is electrostatically adsorbed to the developing roller 7 due to its own charge amount after passing through the nip portion N. Due to the effect, the toner is supplied from the supplying roller 8 to the developing roller 7. A regulating member 11 regulates a part of the toner which has been supplied to the developing roller 7 to form a toner coat having a desired layer thickness on the developing roller 7. The regulated toner drops by gravity and returns to the toner containing unit 210.

The toner coat formed on the developing roller 7 is transferred to only a light portion potential portion in its portion facing (contacting) the photosensitive drum 1 to visualize an electrostatic latent image. On the other hand, toner which has remained on the developing roller 7 without being transferred to the photosensitive drum 1 (hereinafter referred to as "development residual toner") returns into a development container again by rotation of the developing roller 7, and is mixed with toner that newly enters the nip portion N from the temporary toner storage portion V. By a similar mechanism, a toner coat is formed.

In the toner coat formation mechanism, the supply roller 8 has a function of causing a part of toner remaining in the temporary toner storage portion V to enter the nip portion N and a function of rubbing toner which passes through the nip portion N and applying a charge to the toner. If the functions of the supply roller 8 are not sufficiently performed, the following issues occur.

The first issue is a decrease in density of a solid image (a poor solid follow-up performance). The decrease in density of a solid image occurs in a case where only a little toner enters the nip portion N from the temporary toner storage portion V and because a sufficient charge is not applied to the toner which has entered the nip portion N passes through the nip portion N. If the sufficient charge is not applied to the toner, an amount of toner to be electrostatically adsorbed to the developing roller 7 decreases, so that an amount of toner required to form a toner coat cannot be ensured. Therefore, a poor solid follow-up performance occurs. More specifically, to prevent the poor solid follow-up performance, a sufficient amount of toner needs to enter the nip portion N from the temporary toner storage portion V, and a sufficient amount of charge needs to be applied to the toner by sliding friction with the supply roller 8 when the toner passes through the nip portion N.

The second issue is a development ghost. The development ghost occurs in a case where development residual toner and toner newly entering the nip portion N differ in retained charge amount at a timing of their mixing.

Figure 14:
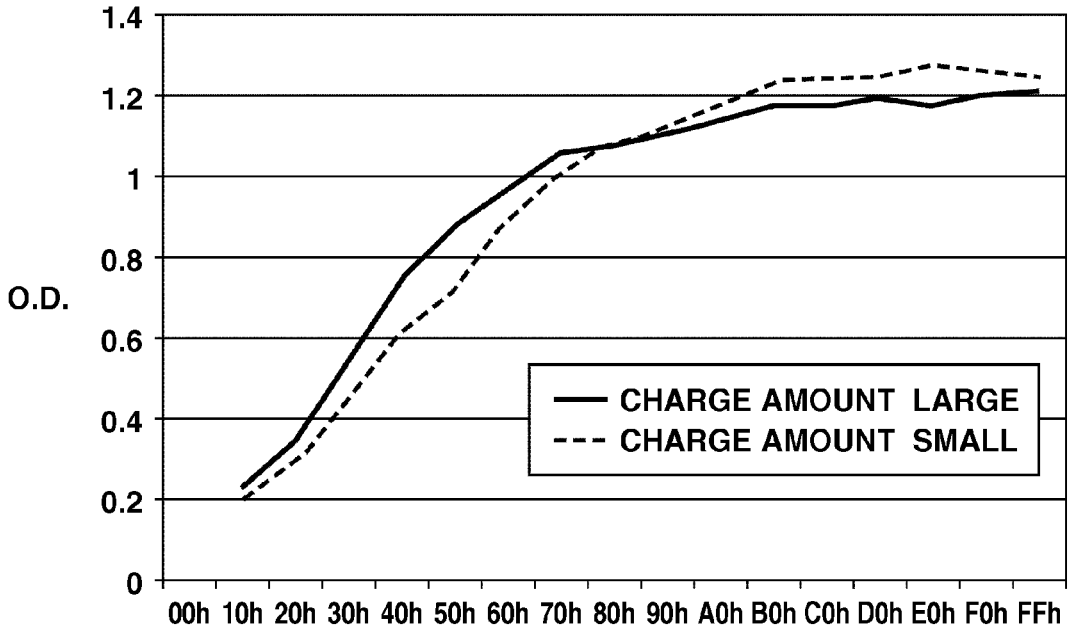
FIG. 14 is a graph illustrating a difference in development property due to a difference in retained charge amount.

First, the development residual toner has already retained a charge because sliding friction thereof with the supply roller 8 and the regulating blade 11 is repeated several times. On the other hand, the toner newly entering the nip portion N from the temporary toner storage portion V has little charge, and has only a charge obtained by sliding friction thereof with the supply roller 8 when it passes through the nip portion N at the time point where it is supplied to the developing roller 7. More specifically, a development residual toner portion that has remained without being developed and a portion to which new toner has been supplied after being developed (hereinafter referred to as a "new toner portion") in the toner in the toner coat on the developing roller 7 differ in retained charge amount. If there is thus the difference in retained charge amount, a difference occurs in development property, and in a case where a halftone image having a certain density is to be printed, a density difference occurs in the halftone image as illustrated in FIG. 14. In other words, if the development residual toner portion and the new toner portion are mixed within the same halftone image, a density difference occurs within the same halftone image. This is an issue of a development ghost.

More specifically, to effectively suppress the occurrence of the development ghost, it is useful to enhance the function of applying a charge to toner from the supply roller 8 and increase an amount of charge to be applied to the toner by the sliding friction with the supply roller 8. Thus, a charge amount of toner newly supplied to the development residual toner portion is increased, so that a difference in charge amount of the toner between the development residual toner portion and the new toner portion can be reduced.

The third issue is the occurrence of a streak caused by toner deterioration. Toner in the development residual toner portion is repeatedly rubbed within the development container. Consequently, a state of the toner changes. This is referred to as toner deterioration. The toner may easily adhere to the regulating blade 11 when it deteriorates. When the toner has adhered to the regulating blade 11, a toner coat may be thinned in a portion where the toner has adhered to the regulating blade 11. Consequently, the portion in which toner coat is thinned appears as a streak on an image. To prevent the occurrence of this issue, a pressure between the supply roller 8 and the developing roller 7 needs to be made appropriate so that more stress than necessary is not given to the toner. A streak can be prevented from occurring within the life of the cartridge by keeping the stress to be given to the toner to a minimum necessary.

If the supply roller 8 cannot thus sufficiently play its role, these issues occur and hinder stable image formation of the cartridge. A configuration of the present exemplary embodiment employed to suppress the occurrence of these issues will be described below.

A relationship between the supply roller 8 and the developing roller 7 according to the present exemplary embodiment will be first described. An amount of intrusion X mm of the supply roller 8 to the developing roller 7 desirably satisfies 0.25 mm<X mm<1.8 mm. In a case of X mm≤0.25 mm, an abutment pressure between the supply roller 8 and the developing roller 7 becomes low, so that their respective forces of sliding friction with toner become small. In other words, a charge application capability to the toner due to sliding friction with the supply roller 8 becomes insufficient under this condition. In a case of 1.8 mm≤X mm, an abutment pressure between the supply roller 8 and the developing roller 7 becomes too high, so that stress to be given to the toner is increased, resulting in advanced toner deterioration. Accordingly, the amount of intrusion X mm of the supply roller 8 into the developing roller 7 desirably satisfies 0.25 mm<X mm<1.8 mm. According to the present exemplary embodiment, the amount of intrusion of the supply roller 8 into the developing roller 7 is set to 1 mm.

It is desirable that a relationship between a peripheral speed $V_{DR}$ of the developing roller 7 and a peripheral speed $V_{RS}$ of the supply roller 8 satisfies $1.2 \leq |V_{RS}/V_{DR}| < 2.0$. If the relationship between the peripheral speeds is set to satisfy $|V_{RS}/V_{DR}| \leq 0.8$, toner entering the nip portion N from the temporary toner storage portion V lacks in amount because the peripheral speed $V_{RS}$ of the supply roller 8 is low. As a result, a poor solid follow-up performance occurs. In a range of $0.8 < |V_{RS}/V_{DR}| < 1.2$, a difference between the peripheral speeds of the developing roller 7 and the supply roller 8 is too small so that sliding friction with toner becomes insufficient. Therefore, a sufficient amount of charge cannot be applied to the toner. Further in the case of $2.0 \leq |V_{RS}/V_{DR}|$, the number of times the toner is rubbed with the supply roller 8 is increased when the toner passes through the nip portion N, resulting in advanced toner deterioration. Accordingly, it is desirable that the relationship between the peripheral speeds of the developing roller 7 and the supply roller 8 satisfies $1.2 \leq |V_{RS}/V_{DR}| < 2.0$. According to the present exemplary embodiment, the outer diameter of the developing roller 7 is 12 mm, and the outer diameter of the supply roller 8 is 15 mm. The developing roller 7 and the supply roller 8 are set to be respectively driven to rotate at 100 rpm and 140 rpm.

DC biases $E_{DR}$ and $E_{RS}$ are respectively applied to the developing roller 7 and the supply roller 8. It is desirable that the DC biases $E_{DR}$ and $E_{RS}$ can satisfy $E_{RS} \leq E_{DR}$. In a case of $E_{RS} > E_{DR}$, toner which has obtained a charge by sliding friction with the supply roller 8 is drawn toward the supply roller 8 by an electric field generated therein. More specifically, in such setting, the supply of the toner to the developing roller 7 runs short, so that a poor solid follow-up performance occurs. According to the present exemplary embodiment, an application bias is set so that $E_{RS} = E_{DR}$ is satisfied. However, the effect of the present invention is not limited to this setting. If $E_{RS} \leq E_{DR}$ is satisfied, a similar effect can be obtained.

Physical property values of the supply roller 8 for suppressing the occurrence of the issues according to the present exemplary embodiment will be described below.

The hardness of the supply roller 8 according to the present exemplary embodiment will be first described. However, the hardness of the supply roller 8 according to the present exemplary embodiment is a value obtained by measuring a load applied when a flat plate having a longitudinal width of 50 mm intrudes into the supply roller 8 by 1 mm from the surface thereof.

To suppress the occurrence of the issues, the hardness of the supply roller 8 is within a range of 140 to 300 gf. When the hardness of the supply roller 8 is lower than 140 gf, an abutment pressure on the developing roller 7 becomes low. Consequently, sliding friction with toner becomes low, so that a sufficient amount of charge cannot be applied to the toner. If the hardness of the supply roller 8 is 300 gf or more, an abutment pressure on the developing roller 7 becomes too high. Consequently, sliding friction with toner becomes too high, so that stress to be given to the toner is increased. In this condition, at the end of the life of the cartridge, issues such as a streak caused by toner deterioration occur. Accordingly, the hardness of the supply roller 8 needs to be in a range of 140 to 300 gf.

Figure 15:
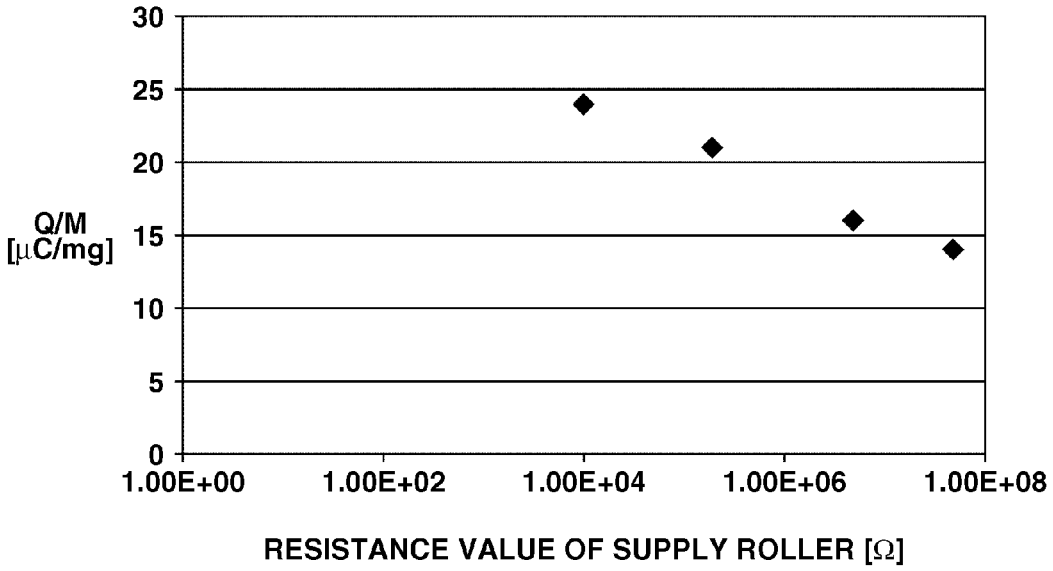
FIG. 15 is a graph illustrating a relationship between a resistance value of a supply roller and a charge amount of a toner coat.

A resistance value of the supply roller 8 according to the present exemplary embodiment is $8\times10^6\Omega$ or less. This is because a charge application capability to toner changes depending on the resistance value of the supply roller 8. FIG. 15 illustrates a charge amount of a toner coat in a new toner portion measured when the resistance value of the supply roller 8 is changed. As illustrated in FIG. 15, as the resistance value of the supply roller 8 is decreased, the charge amount of the toner coat in the new toner portion can be increased. In such a relationship, the resistance value of the supply roller 8 is set to $8\times10^6\Omega$ or less, so that a sufficient amount of charge to suppress the occurrence of a poor solid follow-up performance and a development ghost can be applied to the toner.

The above-described configuration enables the occurrence of the development ghost to be suppressed without any poor solid follow-up performance and streak occurring.

A result of the experiment performed to verify the effect of the present invention will be described below. First, conditions of the experiment are as follows:

*Evaluation of Intermittent Printing with Low Printing Ratio

In this experiment, a two-sheet intermittent printing durability test was performed under an environment of low temperature and low humidity conditions (a temperature of 15° C. and a humidity of 10%). In the printing durability, horizontal lines with an image ratio of 1% were printed as a recorded image. In the printing durability, an evaluation image was printed at the time point where the number of printed sheets was 5000, 10000, 15000, 20000, and 25000, and the presence or absence of the occurrence and the level of each of issues such as a development ghost, a poor solid follow-up performance, and a streak were evaluated. An evaluation criterion of each of the issues is described below.

The development ghost was evaluated using an evaluation image in which 5 mm×5 mm solid black patches were arranged at intervals of 10 mm at a leading edge of a sheet, and a halftone image was printed subsequently to the solid black patches. In the evaluation image, a density of the halftone image in a portion subsequent to the solid black patches and a density of the halftone image in the other portion were measured using SPECTORDENSITOMETER 500 manufactured by X-Rite, and were ranked in the following criteria from a difference between the densities.

A: The density difference was less than 0.02 in the halftone image

B: The density difference was 0.02 or more and less than 0.06 in the halftone image C: The density difference was 0.06 or more in the halftone image The poor solid follow-up performance was evaluated by outputting a solid black image on three consecutive sheets and performing evaluation, described below, using SPECTORDENSITOMETER 500 manufactured by X-Rite from a difference between densities at a leading edge and a trailing edge of the solid image printed on the third sheet. The printing test and the evaluation image were output in a single color.

A: The difference between the densities of the solid black image at the leading edge and the trailing edge of the sheet was less than 0.2

B: The difference between the densities of the solid black image at the leading edge and the trailing edge of the sheet was 0.2 or more and less than 0.3

C: The difference between the densities of the solid black image at the leading edge and the trailing edge of the sheet was 0.3 or more The streak was evaluated by outputting a halftone image and determining whether a streak occurred on the halftone image.

Results of the experiment will be described below. Similar experiments were conducted by a comparison configuration for comparing the effect of the present exemplary embodiment. Results for the comparison configuration will be described together with the result for the configuration according to the present exemplary embodiment.

Experiment 1

As an experiment 1, results of an experiment for verifying the effect of the present exemplary embodiment are indicated in Table 3 for a configuration in which stress to be given to toner is increased.

An exemplary embodiment 4-1 is a case where the supply roller 8 having a resistance value of $8\times10^6\Omega$ and having a hardness of 170 gf was used in the developing unit configuration described according to the present exemplary embodiment. An exemplary embodiment 4-2 is a case where the supply roller 8 having a resistance value of $8\times10^6\Omega$ and having a hardness of 300 gf was used in the developing unit configuration described according to the present exemplary embodiment. A comparative example 4-1 is a case where the supply roller 8 and the developing roller 7 had their respective surfaces moving in opposite directions in a facing portion (contact portion) therebetween. At this time, an amount of intrusion X mm was set to satisfy X mm=1 mm, and DC biases $E_{DR}$ and $E_{RS}$ were set to satisfy $|E_{RS}|-|E_{DR}|=0$. The developing roller 7 and the supply roller 8 were respectively set to be driven to rotate at 100 rpm and 80 rpm. The supply roller 8 was one having a resistance value of $8\times10^6\Omega$ and having a hardness of 170 gf. A comparison example 4-2 is a case where the supply roller 8 having a resistance value of $8\times10^6\Omega$ and having a hardness of 350 gf was used in the developing unit configuration described according to the present exemplary embodiment.

TABLE 3

| | Physical property value of supply roller | | Evaluation issue | | |
|---|---|---|---|---|---|
| Sample name | Resistance value [Ω] | Hardness [gf] | Development ghost | Poor solid follow-up performance | Streak |
| Exemplary embodiment 4-1 | $8\times10^6$ | 170 | A | A | ○ |

TABLE 3-continued

| Sample name | Physical property value of supply roller: Resistance value [Ω] | Hardness [gf] | Evaluation issue: De-velopment ghost | Poor solid follow-up performance | Streak |
|---|---|---|---|---|---|
| Exemplary embodiment 4-2 | $8 \times 10^6$ | 300 | A | A | ○ |
| Comparative example 4-1 | $8 \times 10^6$ | 170 | A | A | x |
| Comparative example 4-2 | $8 \times 10^6$ | 350 | A | A | x |

If the configuration described in the present exemplary embodiment was used and the hardness of the supply roller 8 was in the range of 140 to 300 gf, like in the exemplary embodiment 4-1 and exemplary embodiment 4-2, toner deterioration could be suppressed. Thus, no streak occurred even at the end of the life of the cartridge. Therefore, a high-quality image could be stably output.

On the other hand, when the supply roller 8 and the developing roller 7 had their respective surfaces moving in the opposite directions in the facing portion (contact portion) therebetween, like in the comparative example 4-1, a difference in peripheral speed between the supply roller 8 and the developing roller 7 became too large. Thus, the number of times of sliding friction to which toner was subjected when it passed through the nip portion N became too large, resulting in advanced toner deterioration. As a result, a streak occurred at the end of the life of the cartridge.

When the supply roller 8 having a hardness of 300 gf or more was used, like in the comparative example 4-2, toner deterioration was advanced, as described above. As a result, a streak occurred at the end of the life of the cartridge.

Experiment 2

As an experiment 2, results of an experiment for verifying the effect of the present exemplary embodiment are indicated in Table 4 for a configuration in which a force of friction between a developing roller 7 and a supply roller 8 is weakened. An exemplary embodiment 4-3 is a case where the supply roller 8 having a resistance value of $8\times10^6\Omega$ and having a hardness of 140 gf was used in the developing unit configuration described according to the present exemplary embodiment. A comparative example 4-3 is a case where the supply roller 8 having a resistance value of $8\times10^6\Omega$ and having a hardness of 100 gf was used in the developing unit configuration described according to the present exemplary embodiment.

TABLE 4

| Sample name | Physical property value of supply roller: Resistance value [Ω] | Hardness [gf] | Evaluation issue: De-velopment ghost | Poor solid follow-up performance | Streak |
|---|---|---|---|---|---|
| Exemplary embodiment 4-1 | $8 \times 10^6$ | 170 | A | A | ○ |

TABLE 4-continued

| Sample name | Physical property value of supply roller: Resistance value [Ω] | Hardness [gf] | Evaluation issue: De-velopment ghost | Poor solid follow-up performance | Streak |
|---|---|---|---|---|---|
| Exemplary embodiment 4-3 | $8 \times 10^6$ | 140 | B | A | ○ |
| Comparative example 4-3 | $8 \times 10^6$ | 100 | C | B | ○ |

If the supply roller 8 having a hardness of 140 gf or more was used, like in the exemplary embodiment 4-1 and the exemplary embodiment 4-3, a sufficient amount of charge was able to be applied to toner, so that the occurrence of a development ghost and a poor solid follow-up performance were able to be suppressed.

On the other hand, if the supply roller 8 having a hardness of 140 gf or less was used, like in the comparative example 4-3, an abutment pressure between the supply roller 8 and the developing roller 7 became low, so that a force of friction with toner was reduced. Therefore, a sufficient amount of charge was unable to be applied to the toner so that a development ghost occurred. An electrostatic force for adhering to the developing roller 7 was reduced after the toner had passed through the nip portion N for a similar reason. Therefore, the supply of the toner to the developing roller 7 ran short, so that a poor solid follow-up performance occurred.

Experiment 3

As an experiment 3, results of an experiment for verifying the effect of the present exemplary embodiment are illustrated in Table 5 for a configuration in which a charge application capability from the supply roller 8 to toner is low. An exemplary embodiment 4-4 is a case where the supply roller 8 having a resistance value of $4\times10^5\Omega$ and having a hardness of 170 gf was used in the developing unit configuration described according to the present exemplary embodiment. A comparative example 4-4 is a case where the supply roller 8 having a resistance value of $2\times10^7\Omega$ and having a hardness of 170 gf was used in the developing unit configuration described according to the present exemplary embodiment.

TABLE 5

| Sample name | Physical property value of supply roller: Resistance value [Ω] | Hardness [gf] | Evaluation issue: De-velopment ghost | Poor solid follow-up performance | Streak |
|---|---|---|---|---|---|
| Exemplary embodiment 4-1 | $8 \times 10^6$ | 170 | A | A | ○ |
| Exemplary embodiment 4-4 | $4 \times 10^5$ | 170 | A | A | ○ |
| Comparative example 4-4 | $2 \times 10^7$ | 170 | C | C | ○ |

If the configuration according to the present exemplary embodiment was used, like in the exemplary embodiment 4-1 and the exemplary embodiment 4-4, a charge application capability to toner was high, and the toner was able to retain a sufficient charge. Therefore, a poor solid follow-up performance did not occur, and the occurrence of a development ghost was able to be suppressed.

If the supply roller 8 having a resistance value of $8\times10^6\Omega$ or more was used, like in the comparative example 4-4, a charge application capability to toner was reduced. Therefore, a development ghost and a poor solid follow-up performance occurred.

As described above, the effect of the present exemplary embodiment was verified through the experiments 1 to 3. More specifically, in the configuration in which the developing roller 7 and the supply roller 8 have their respective surfaces moving in the same direction within the nip portion N therebetween, when the supply roller 8 having a resistance value of $8\times10^6\Omega$ or less and having a hardness of 140 gf to 300 gf is used, issues caused by the occurrence of a poor solid follow-up performance and toner deterioration at the end of the life of the cartridge can be suppressed while suppressing the occurrence of a development ghost.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2012-100955 filed Apr. 26, 2012 and No. 2012-100957 filed Apr. 26, 2012, which are hereby incorporated by reference herein in their entirety.

What is claimed is:

1. A developing device used in an electrophotographic image forming apparatus, the developing device comprising:

a developer bearing member configured to bear a developer and develop an electrostatic latent image;

a supply member assembled in a frame, configured to supply the developer to the developer bearing member, to be arranged to form a nip portion between the supply member and the developer bearing member, and to rotate in a direction in which its surface moves from an upper end to a lower end of the nip portion;

a containing unit configured to be arranged below the supply member in a vertical direction and contain the developer; and a conveyance member configured to be arranged in the containing unit, wherein the conveyance member is configured to rotate in a same direction as the supply member and convey the developer contained in the containing unit via a path between the supply member and the frame so as to be stored above the nip portion in the vertical direction.

2. The developing device according to claim 1, wherein the developer bearing member rotates in a direction in which its surface moves from the upper end to the lower end of the nip portion.

3. The developing device according to claim 2, wherein a peripheral speed of the supply member is higher than a peripheral speed of the developer bearing member.

4. The developing device according to claim 1, wherein the developer bearing member and the supply member are arranged so that an upper end of the supply member becomes higher than an upper end of the developer bearing member.

5. The developing device according to claim 1, wherein the developer bearing member and the supply member are arranged so that an angle between a horizontal line and an upper common tangential line to the developer bearing member and the supply member among the common tangential lines thereto becomes smaller than a repose angle of the developer.

6. The developing device according to claim 1, wherein an outer diameter of the supply member is larger than an outer diameter of the developer bearing member.

7. The developing device according to claim 1, wherein the supply member includes a foam layer on its surface.

8. A process cartridge comprising an image bearing member configured to bear an electrostatic latent image and a developing device according to claim 1, and configured to be detachably attached to an image forming apparatus main body.

9. An image forming apparatus comprising an image bearing member configured to bear an electrostatic latent image and a developing device according to claim 1, and configured to form an image on a recording material.

* * * * *